US009954302B2

(12) United States Patent
Kamei

(10) Patent No.: US 9,954,302 B2
(45) Date of Patent: Apr. 24, 2018

(54) CONTACT AND CONNECTOR INCLUDING CONTACT

(71) Applicant: JAPAN AVIATION ELECTRONICS INDUSTRY, LIMITED, Shibuya-ku, Tokyo (JP)

(72) Inventor: Yuji Kamei, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 64 days.

(21) Appl. No.: 14/867,505

(22) Filed: Sep. 28, 2015

(65) Prior Publication Data

US 2016/0190726 A1 Jun. 30, 2016

(30) Foreign Application Priority Data

Dec. 25, 2014 (JP) ..... 2014-263134

(51) Int. Cl.

| | |
|---|---|
| ***H01R 24/00*** | (2011.01) |
| ***H01R 13/502*** | (2006.01) |
| ***H01R 13/11*** | (2006.01) |
| ***H01R 13/18*** | (2006.01) |

(52) U.S. Cl.
CPC ..... *H01R 13/502* (2013.01); *H01R 13/113* (2013.01); *H01R 13/18* (2013.01)

(58) Field of Classification Search
CPC .... H01R 13/113; H01R 13/18; H01R 13/502; H01R 13/187
USPC ..... 439/660
See application file for complete search history.

(56) References Cited

U.S. PATENT DOCUMENTS

| | | | | |
|---|---|---|---|---|
| 5,921,821 | A * | 7/1999 | Oka | H01R 13/113 439/745 |
| 5,951,338 | A * | 9/1999 | Seko | H01R 13/18 439/843 |
| 7,252,559 | B1 * | 8/2007 | Morello | H01R 4/185 439/843 |
| 2007/0093130 | A1 * | 4/2007 | Shiraishi | H01R 13/113 439/587 |
| 2012/0100731 | A1 * | 4/2012 | Umemoto | H01R 13/113 439/86 |

(Continued)

FOREIGN PATENT DOCUMENTS

JP 08250178 A 9/1996

*Primary Examiner* — Abdullah Riyami
*Assistant Examiner* — Nader Alhawamdeh
(74) *Attorney, Agent, or Firm* — Holtz Holtz & Volek PC

(57) ABSTRACT

A contact increased in contact reliability by suppressing variation in contact area between the contact and a mating contact. A contact body including a contact portion that is brought into contact with a contact portion of a male-side contact, and a supporting member formed separate from the contact body, for receiving therein the contact portion and movably supporting the contact portion form a female-side contact. The supporting member includes a supporting member body for receiving therein the contact portion and the contact portion, first and second spring portions and provided on the supporting member body, for bringing the contact portion inserted in the supporting member body and the contact portion into contact with each other, and restricting portions provided on the supporting member body, for restricting movement of the male-side contact in a spring portion-bending direction of the first and second spring portions.

15 Claims, 24 Drawing Sheets

(56) References Cited

U.S. PATENT DOCUMENTS

| | | | | |
|---|---|---|---|---|
| 2013/0115830 | A1* | 5/2013 | Seifert | H01R 4/185<br>439/888 |
| 2013/0288512 | A1* | 10/2013 | Oka | H01R 13/6272<br>439/353 |

* cited by examiner

CONTACT AND CONNECTOR INCLUDING CONTACT

BACKGROUND OF THE INVENTION

Field of the Invention

This invention relates to a contact and a connector including the contact.

Description of the Related Art

As shown in FIGS. 22 to 24, conventionally, there has been proposed a female terminal fitting 910 formed by integrally assembling a terminal body 911 which is formed by bending a conductive metal plate and includes a terminal fitting portion 912 and a wire connection portion 913, and an elastic contact body 925 which is a separate component from the terminal body 911 and is formed by bending a conductive metal plate (see Japanese Laid-Open Patent Publication (Kokai) No. H08-250178). The terminal fitting portion 912 has a box shape having a horizontally long rectangular cross-section, and has an insertion opening 916 formed in a front end thereof for allowing a male terminal fitting, not shown, to be inserted. A ceiling plate 918 of the terminal fitting portion 912 is formed with a pair of tab contact portions 918A which protrude downward. The pair of tab contact portions 918A each have a semi-cylindrical shape, and extend in a front-rear direction (see FIGS. 22 and 23). A bottom plate 914 is formed with an excessive bending-preventing section 923 curving upward. The excessive bending-preventing section 923 is a part for preventing an elastic bending section 928, described hereinafter, from being excessively bent.

The wire connection portion 913 includes an insulation barrel 913A and a wire barrel 913B. The insulation barrel 913A is connected to a resin coated part of a wire, not shown, and the wire barrel 913B is connected to the core of the wire.

The elastic contact body 925 is formed by bending a plate having a rectangular shape. A front end portion of the elastic contact body 925 is an engaging portion 926 forming a flat plate shape. A rear end portion of the elastic contact body 925 is formed with a holding portion 927 by bending the rear end portion into a U shape, as viewed from the side. The holding portion 927 is formed by an upper plate portion 927A, a rising portion 927B, and a lower plate portion 927C. The holding portion 927 has a dimension in the front-rear direction which is set to be slightly smaller than a spacing between a front stopper 920F and a rear stopper 920R of the terminal fitting portion 912. The upper plate portion 927A is arranged between the front stopper 920F and the rear stopper 920R of the terminal fitting portion 912 in a manner immovable in the front-rear direction. Further, the dimension of the holding portion 927 in a height direction is set to be equal to a spacing between the bottom plate 914 and a protection plate 919 of the terminal fitting portion 912. The upper plate portion 927A is in contact with the protection plate 919 and the lower plate portion 927C is in contact with the bottom plate 914 (see FIG. 22), whereby the elastic contact body 925 is held within the terminal fitting portion 912 in a manner immovable in a vertical direction.

The elastic bending section 928 is formed by bending a portion of the elastic contact body 925 between the engaging portion 926 and the holding portion 927 such that the portion is caused to curve upward. A tab contact portion 928A protruding upward is formed on the top of the elastic bending portion 928.

Right and left end portions of the engaging portion 926 of the elastic contact body 925 extend forward under pressing portions 922 of the terminal fitting portion 912 in a manner movable in the front-rear direction.

When a tab (not shown) of the male terminal fitting is inserted between the tab contact portions 918A of the terminal fitting portion 912 and the tab contact portion 928A of the elastic contact body 925, the elastic bending portion 928 is bent, whereby the tab of the male terminal fitting is sandwiched between the tab contact portions 918A of the terminal fitting portion 912 and the tab contact portion 928A of the elastic contact body 925. A constant contact force is generated between the tab of the male terminal fitting and the tab contact portions 918A of the terminal fitting portion 912, and between the tab of the male terminal fitting and the tab contact portion 928A of the elastic contact body 925, respectively, by action of a returning force of the elastic bending portion 928. The tab of the male terminal fitting is brought into line contact with the tab contact portions 918A, and is brought into point contact with the tab contact portion 928A.

Usually, the elastic contact body 925 is made of stainless steel, and the terminal body 911 is made of copper or copper alloy. Therefore, electric current mainly flows via a contact portion between the tab of the male terminal fitting and the tab contact portions 918A of the terminal fitting portion 912.

If the female terminal fitting 910 or the male terminal fitting is low in shaping accuracy, or if an electric wire connected to the wire connection portion 913 of the female terminal fitting 910 is pulled, misalignment may occur between the female terminal fitting 910 and the male terminal fitting which are in a connected state.

For example, if the electric wire connected to the wire connection portion 913 of the female terminal fitting 910 is pulled, causing inclination of the tab contact portions 918A of the female terminal fitting 910 with respect to the tab of the male terminal fitting, a parallel positional relationship between the tab of the male terminal fitting and the tab contact portions 918A of the female terminal fitting 910 is lost, which reduces a contact area between the tab of the male terminal fitting and the tab contact portions 918A of the female terminal fitting 910. When the contact area between the tab of the male terminal fitting and the tab contact portions 918A of the female terminal fitting 910 is reduced, the contact resistance is largely changed, so that there is a fear of reduction of the contact reliability.

SUMMARY OF THE INVENTION

The present invention has been made in view of these circumstances, and an object thereof is to increase the contact reliability of the contact by suppressing variation in a contact area between a contact and a mating contact.

To attain the above object, in a first aspect of the present invention, there is provided a contact comprising a contact body including a contact portion that is brought into contact with a mating contact portion of a mating contact, and a supporting member that is a component separate from the contact body, and not only receives therein the mating contact portion, but also supports the contact portion in a movable manner, characterized in that the supporting member includes a supporting member body that receives therein the mating contact portion and the contact portion, a spring portion that is provided on the supporting member body, for bringing the mating contact portion inserted into the supporting member body and the contact portion into contact with each other, and a restricting portion that is provided on the supporting member body, for restricting movement of the mating contact in a direction of bending of the spring portion, and the contact portion includes a contact portion body having a flat plate shape, and a contact point portion protruding from the contact portion body into an inside of the supporting member body.

Preferably, the contact point portion extends in a direction of a central axis of the supporting member.

Preferably, the supporting member body has a square tube shape, the supporting member body includes an upper wall and a lower wall which are opposed to each other, and the spring portion is provided on at least one of the upper wall and the lower wall.

More preferably, the supporting member body includes a pair of side walls which are at right angles to the upper wall and the lower wall, respectively, and are opposed to each other, the pair of side walls each have a hole formed therethrough, and the contact portion includes a plurality of protrusions which are continuous with the contact portion body, and are inserted into the holes and supported by the pair of side walls in a movable manner.

More preferably, the restricting portion is provided on each of the upper wall and the lower wall.

Preferably, the supporting member body has a U shape in cross-section, the supporting member body includes a wall opposed to the contact portion body, and the spring portion is provided on the wall.

Further preferably, the supporting member body includes a pair of side walls which are at right angles to the wall, respectively, and are opposed to each other, the pair of side walls each have a hole formed therethrough, and the contact portion includes a plurality of protrusions which are continuous with the contact portion body, and are inserted into the holes and supported by the pair of side walls in a movable manner.

Preferably, the supporting member includes a stopper portion for restricting movement of the contact portion in a direction of insertion thereof into the supporting member.

More preferably, the restricting portion also serves as the stopper portion.

Preferably, the restricting portion has a J shape in cross-section.

Preferably, the contact body is different in thickness from the supporting member, and the contact body is larger in thickness than the supporting member.

Preferably, the contact body includes a connection portion that is continuous with the contact portion and is connected to an object to be connected.

More preferably, the object to be connected is a cable.

To attain the above object, in a second aspect of the present invention, there is provided a connector characterized by comprising the contact according to any one of the contacts described above, and a housing that accommodates the contact, and holds the supporting member.

According to the present invention, it is possible to increase the contact reliability of the contact by suppressing variation in contact area between the contact and the mating contact.

The above and other objects, features and advantages of the present invention will become more apparent from the following detailed description taken in conjunction with the accompanying drawings.

DETAILED DESCRIPTION OF THE PREFERRED EMBODIMENT

Figure 1:
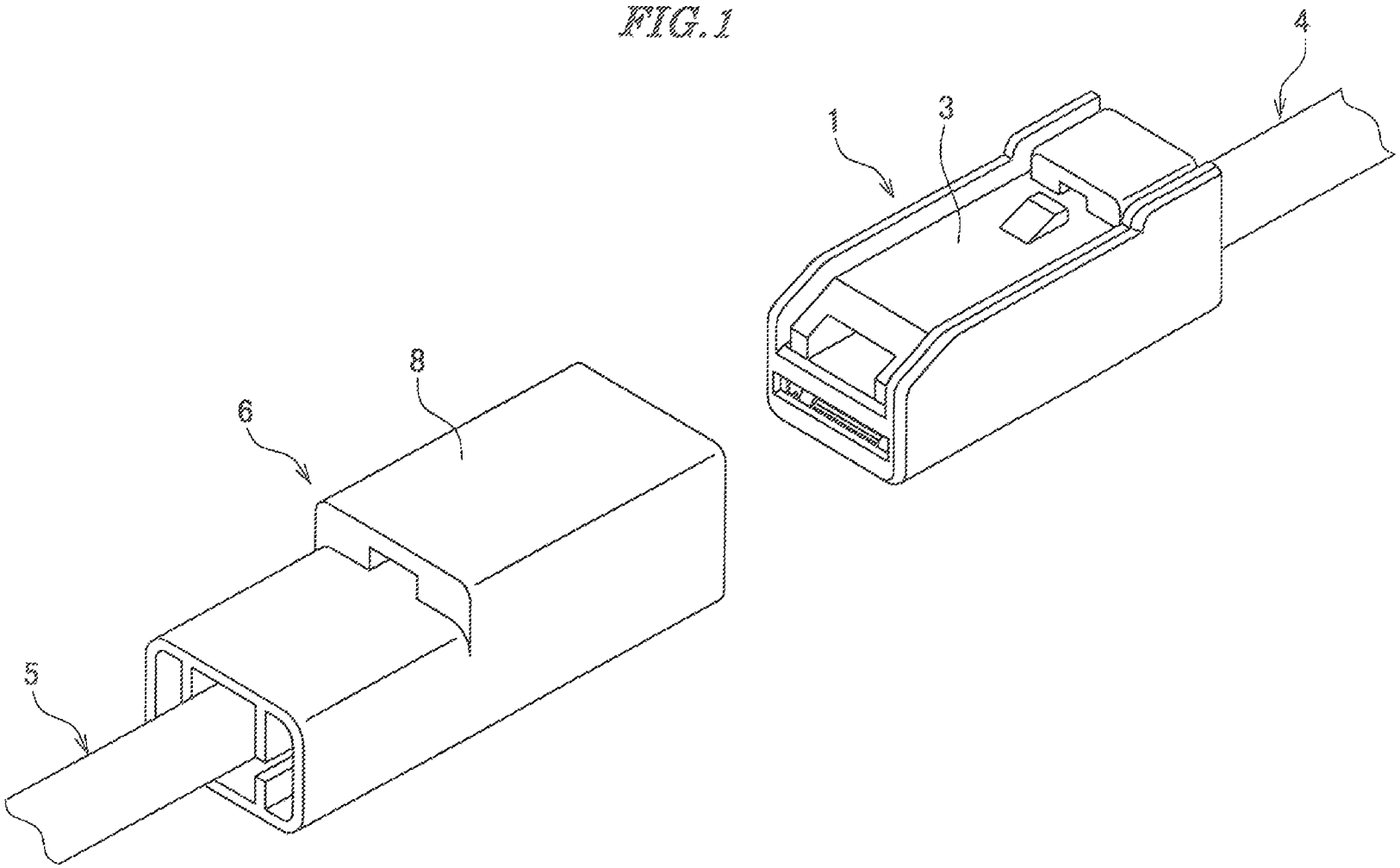
FIG. 1 is a perspective view of a female connector according to a first embodiment of the present invention and a male connector in a state in which the male connector is about to be fitted to the female connector.
Figure 2:
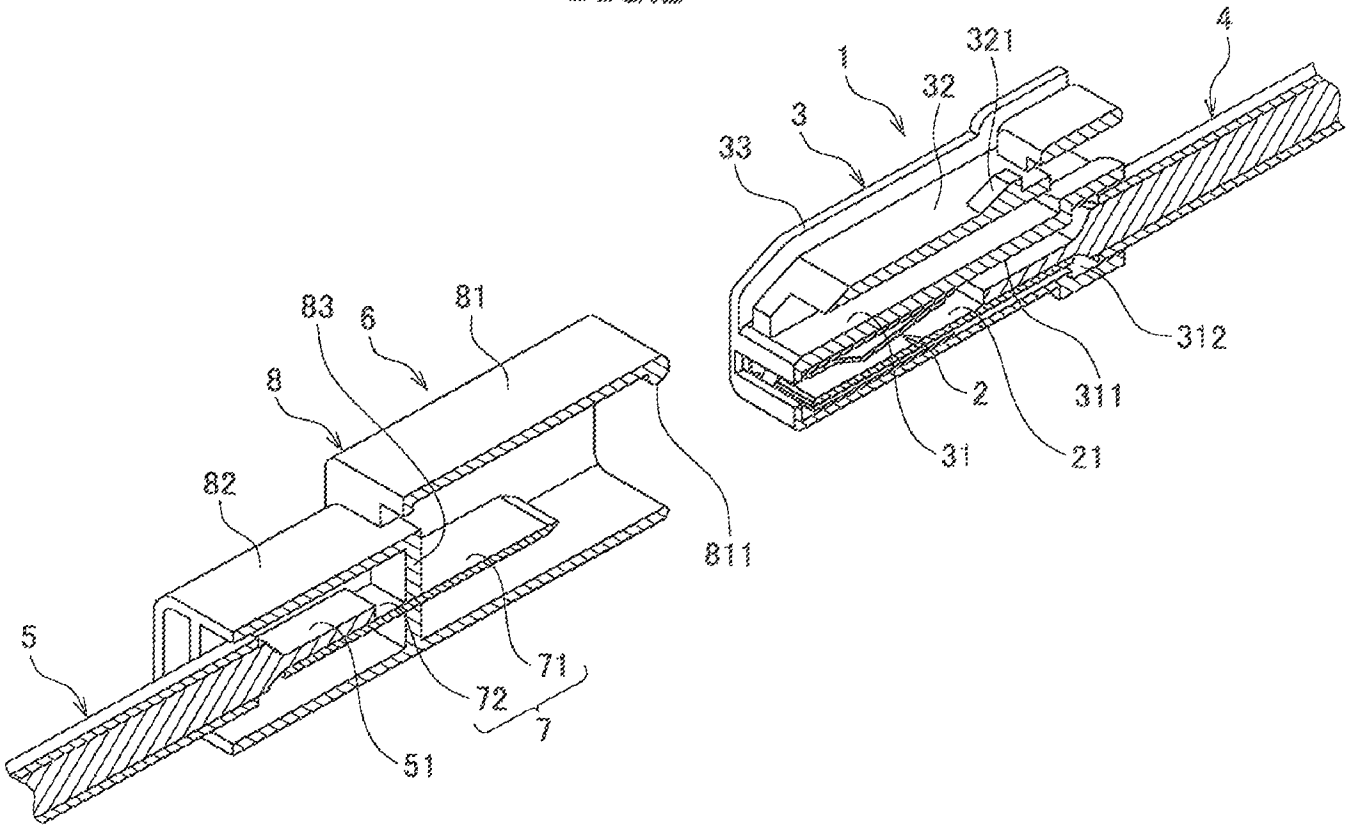
FIG. 2 is a cross-sectional view of the female connector and the male connector shown in FIG. 1.

The present invention will now be described in detail with reference to the drawings showing a preferred embodiment thereof.

A description will be given of a female connector according to the first embodiment of the present invention with reference to FIGS. 1 to 18.

As shown in FIGS. 1 to 4, the female connector (connector), denoted by reference numeral 1, is connected to a male connector 6 connected to a cable 5. The female connector 1 is connected to a cable (object to be connected) 4.

The female connector 1 is comprised of a female-side contact (contact) 2 and a female-side housing (housing) 3.

As shown in FIGS. 4 to 14, the female-side contact 2 is comprised of a contact body 21 and a supporting member 22.

Figure 11:
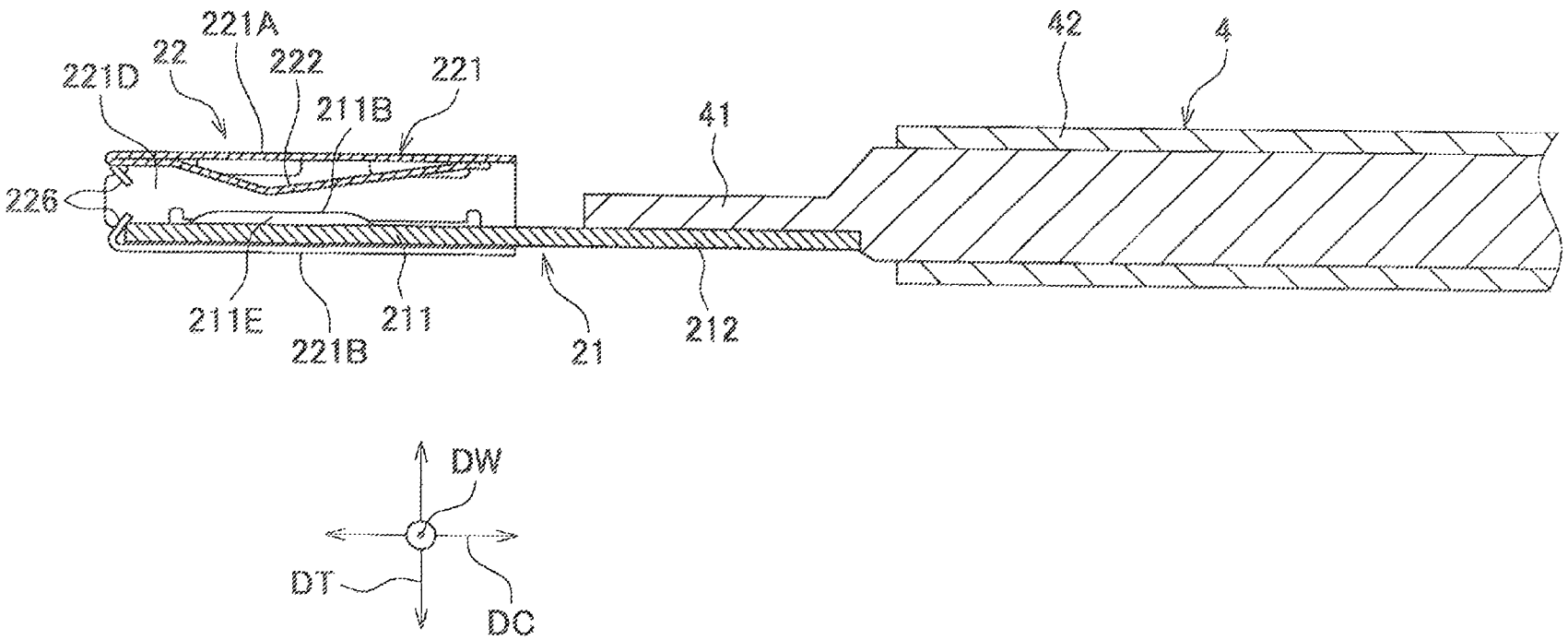
FIG. 11 is a cross-sectional view taken along XI-XI in FIG. 10.
Figure 12:
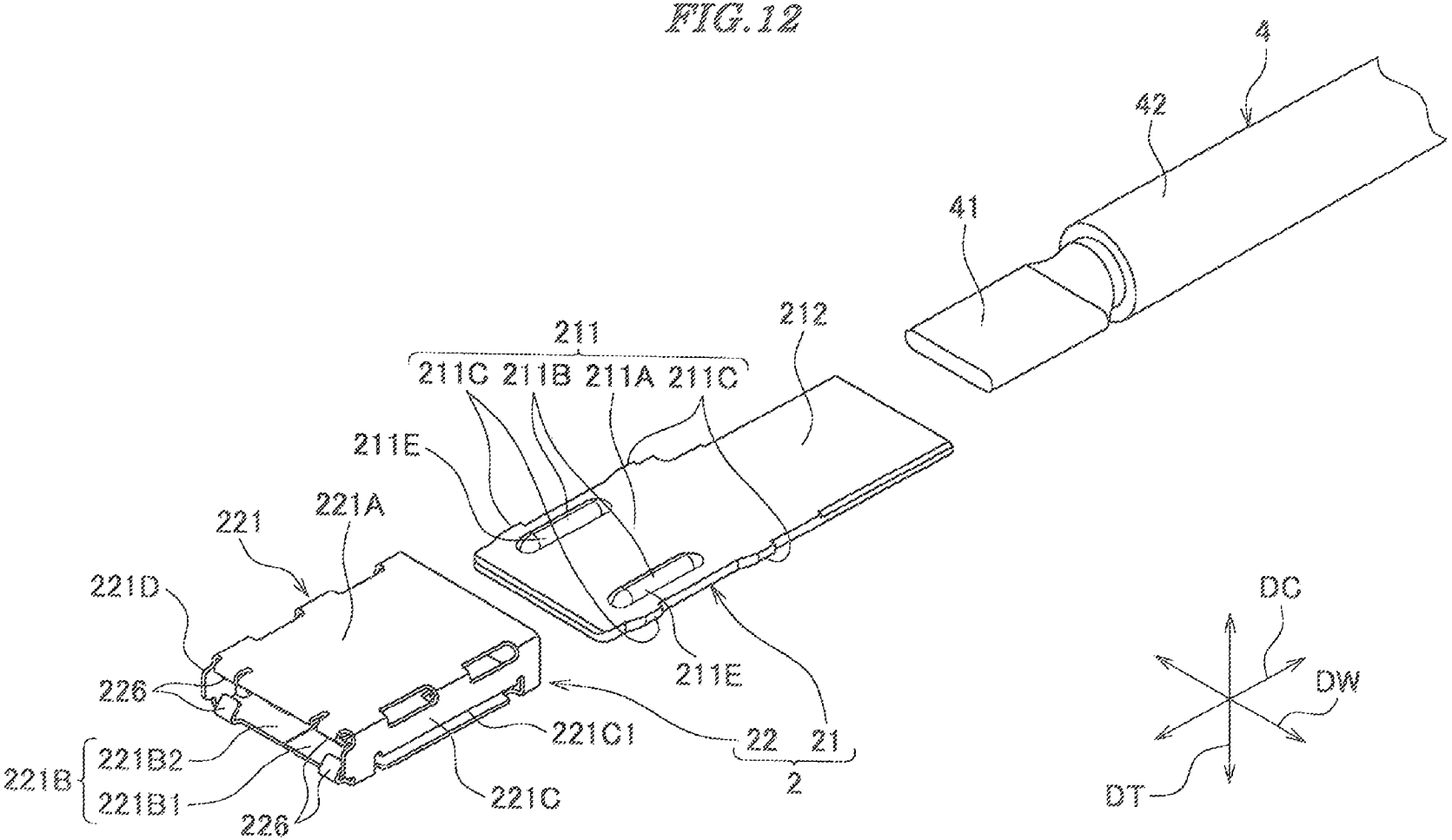
FIG. 12 is an exploded perspective view of the female-side contact shown in FIG. 5.

The contact body 21 includes a contact portion 211 which is brought into contact with a contact portion (mating contact portion) 71 of a male-side contact (mating contact) 7, having a flat plate shape, of the male connector 6, and a connection portion 212 which is continuous with the contact portion 211 and is connected to a cable 4 (see FIGS. 11 and 12). As a material for the contact body 21, there may be used, for example, copper, copper alloy, or the like.

The contact portion 211 includes a contact portion body 211A having a flat plate shape, contact point portions 211B which protrude from an upper surface of the contact portion body 211A, and protrusions 211C which protrude from opposite side surfaces of the contact portion body 211A. In the female-side contact 2, a thick metal plate can be used as the contact body 21, and hence the female-side contact 2 is suitable for a high-current contact. Further, even if the contact portion body 211A of the contact body 21 is large in thickness, the contact portion body 211A can be easily processed because of the flat plate shape thereof.

The two contact point portions 211B each extend along a direction DC of the central axis of the supporting member 22. The contact point portions 211B each have a semicircular shape in cross-section, and a cylindrical surface 211E.

The protrusions 211C are provided in pairs on the opposite side surfaces of the contact portion body 211A, respectively. Each protrusion 211C is wedge-shaped. The protrusion 211C on the rear side (toward the cable 4) of the two protrusions 211C provided on one side surface of the contact portion body 211A enters a hole 221C1 of a side wall 221C, and is hooked on a rear end portion of the side wall 221C (see FIGS. 5 and 7). The protrusion 211C on the rear side of the two protrusions 211C provided on the other side surface of the contact portion body 211A enters a hole 221D1 of a side wall 221D (see FIGS. 14 and 17), and is hooked on a rear end portion of the side wall 221D.

The connection portion 212 has a flat plate shape. A core wire 41 of the cable 4 is soldered to the connection portion 212. The cable 4 includes the core wire 41 and a sheathing portion 42 for sheathing the core wire 41 (see FIG. 11). Note that the core wire 41 and a core wire 51 of the respective cables 4 and 5 appearing in FIG. 4 and others are illustrated in a simplified manner.

The supporting member 22 is a separate component from the contact body 21. The supporting member 22 receives therein the contact portion 71 of the male-side contact 7 of the male connector 6, and supports the contact portion 211 of the contact body 21 in a movable manner. Note that the phrase "to support the contact portion 211 in a movable manner" is to be interpreted as to support the contact portion 211 in a manner movable in a bending direction of a first spring portion (spring portion) 222 and second spring portions (spring portion) 223 (hereinafter referred to as the "spring portion-bending direction DT").

Figure 13:
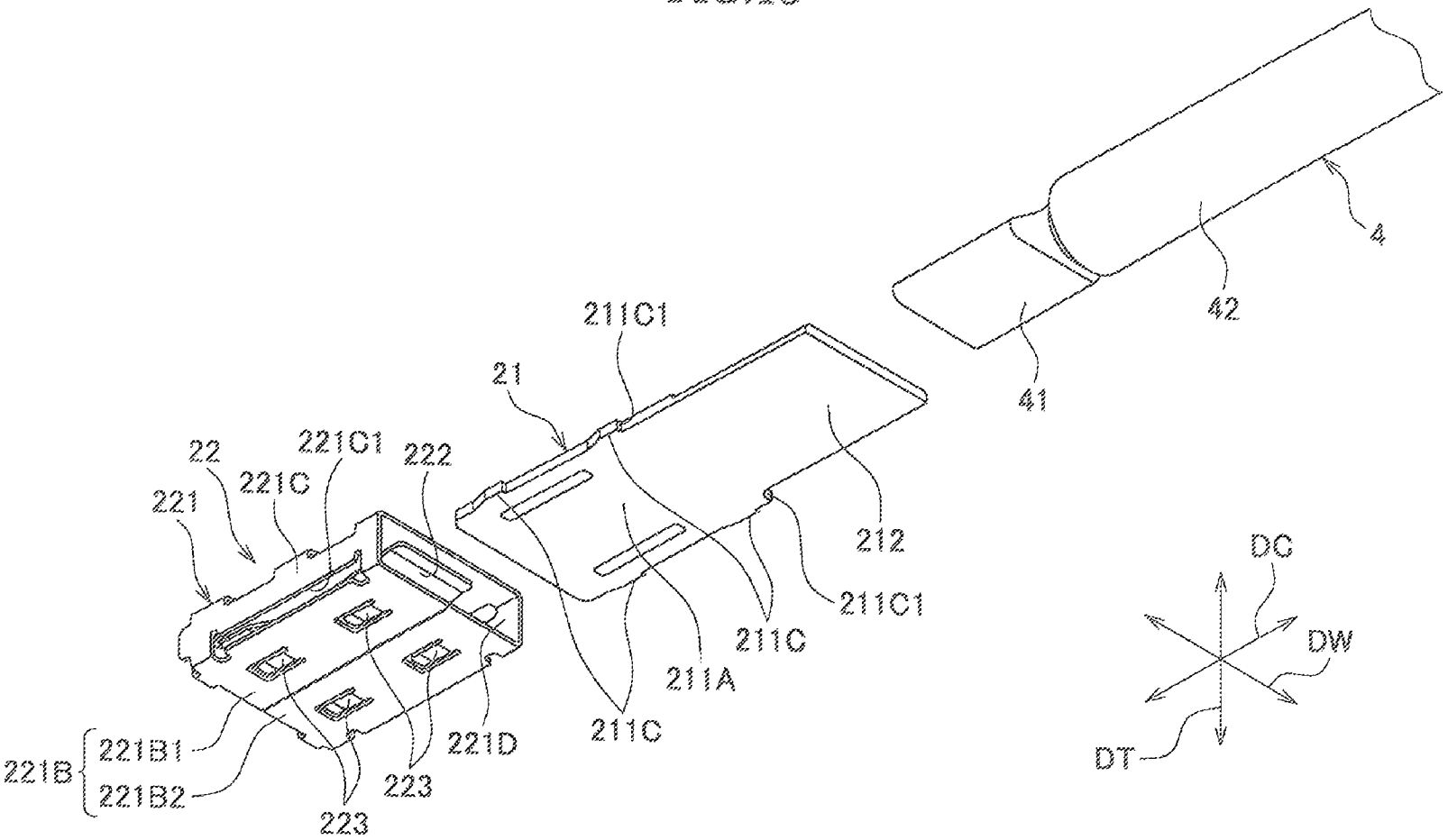
FIG. 13 is an exploded perspective view of the female-side contact shown in FIG. 12, as viewed obliquely from below.
Figure 14:
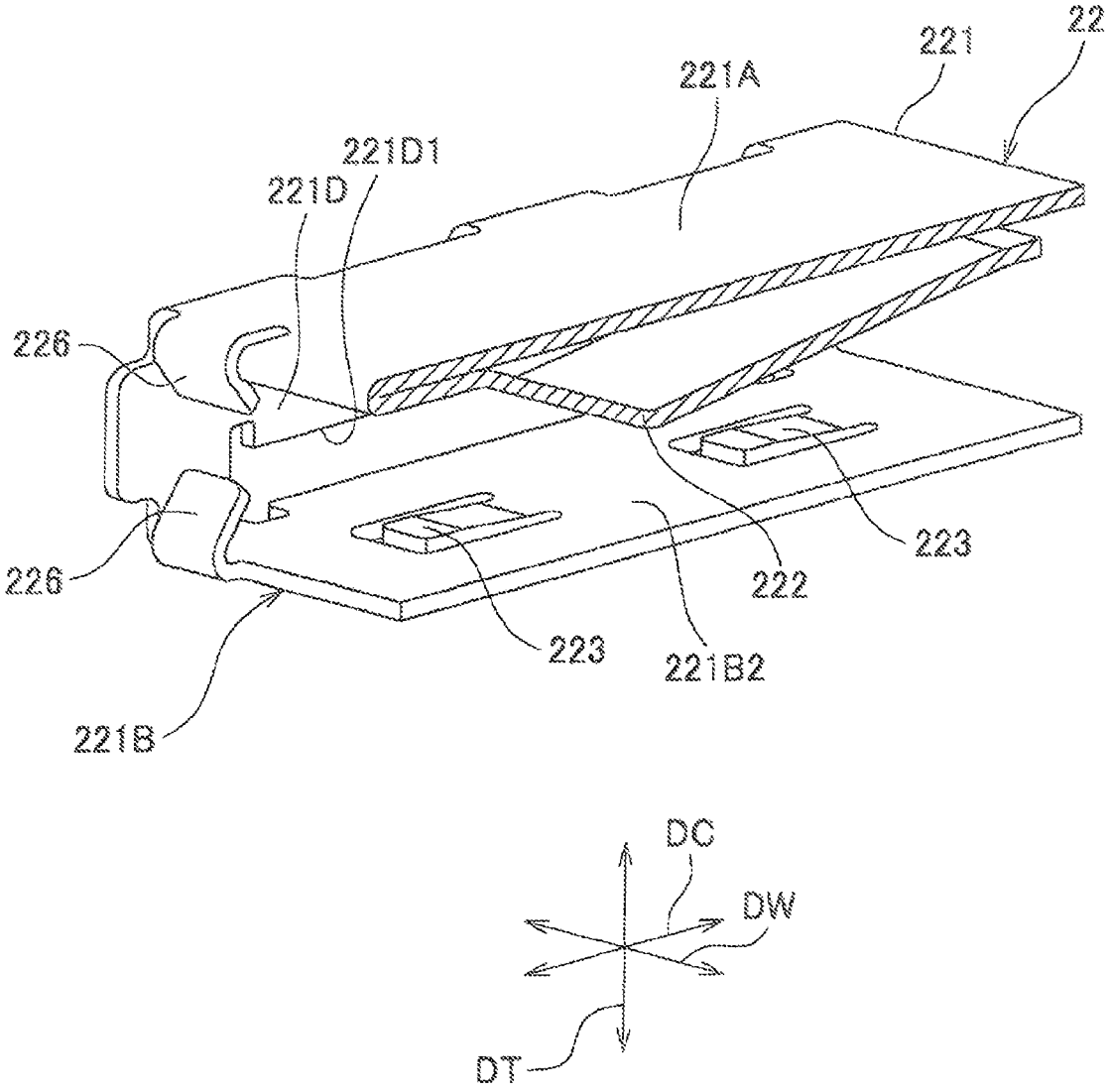
FIG. 14 is a cross-sectional view of the female-side contact shown in FIG. 5, in a state in which a supporting member thereof is partially cut away.
Figure 15:
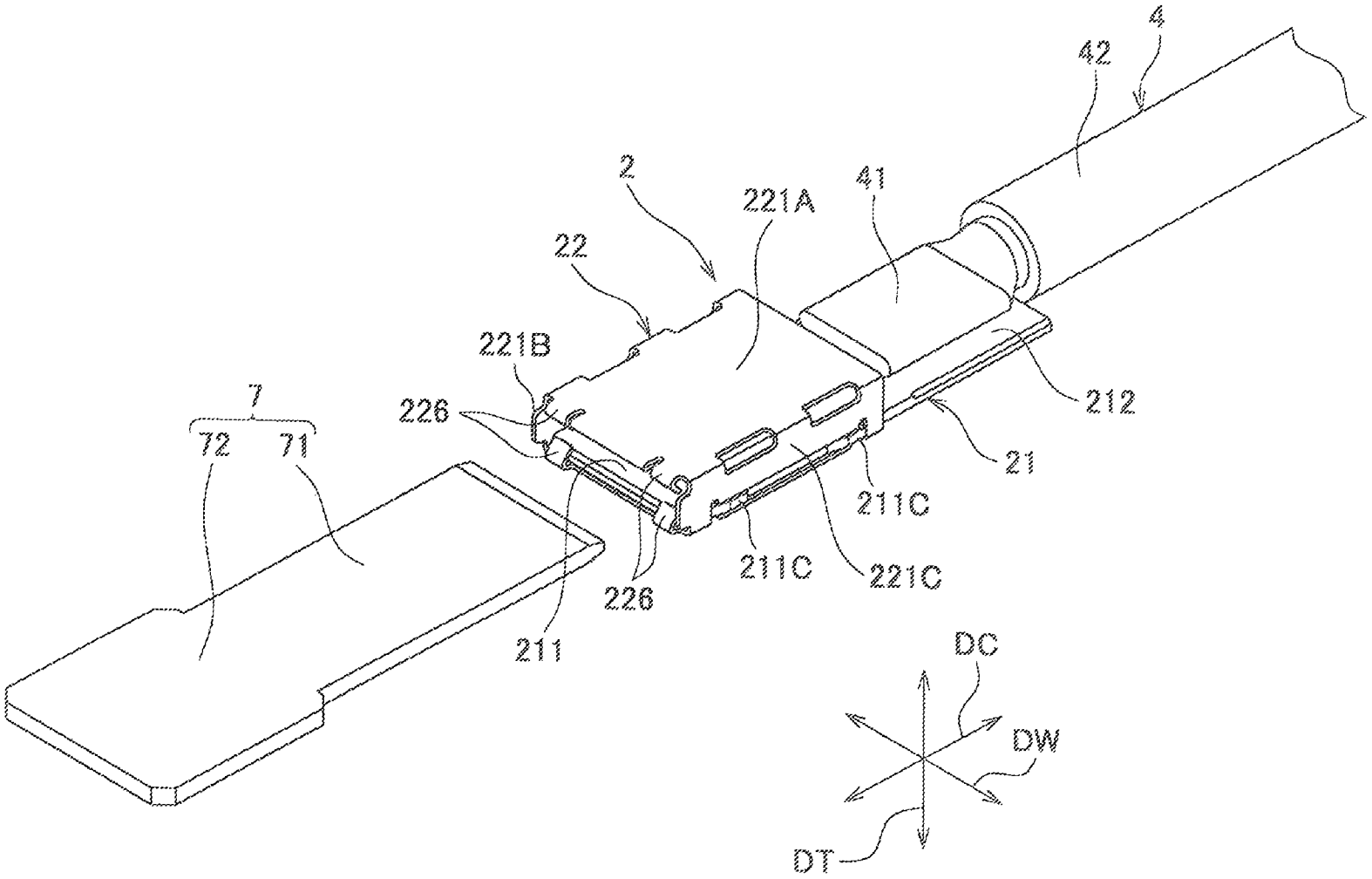
FIG. 15 is a perspective view of the female-side contact shown in FIG. 5 and a male-side contact in a state in which the male-side contact is about to be inserted into the female-side contact.
Figure 16:
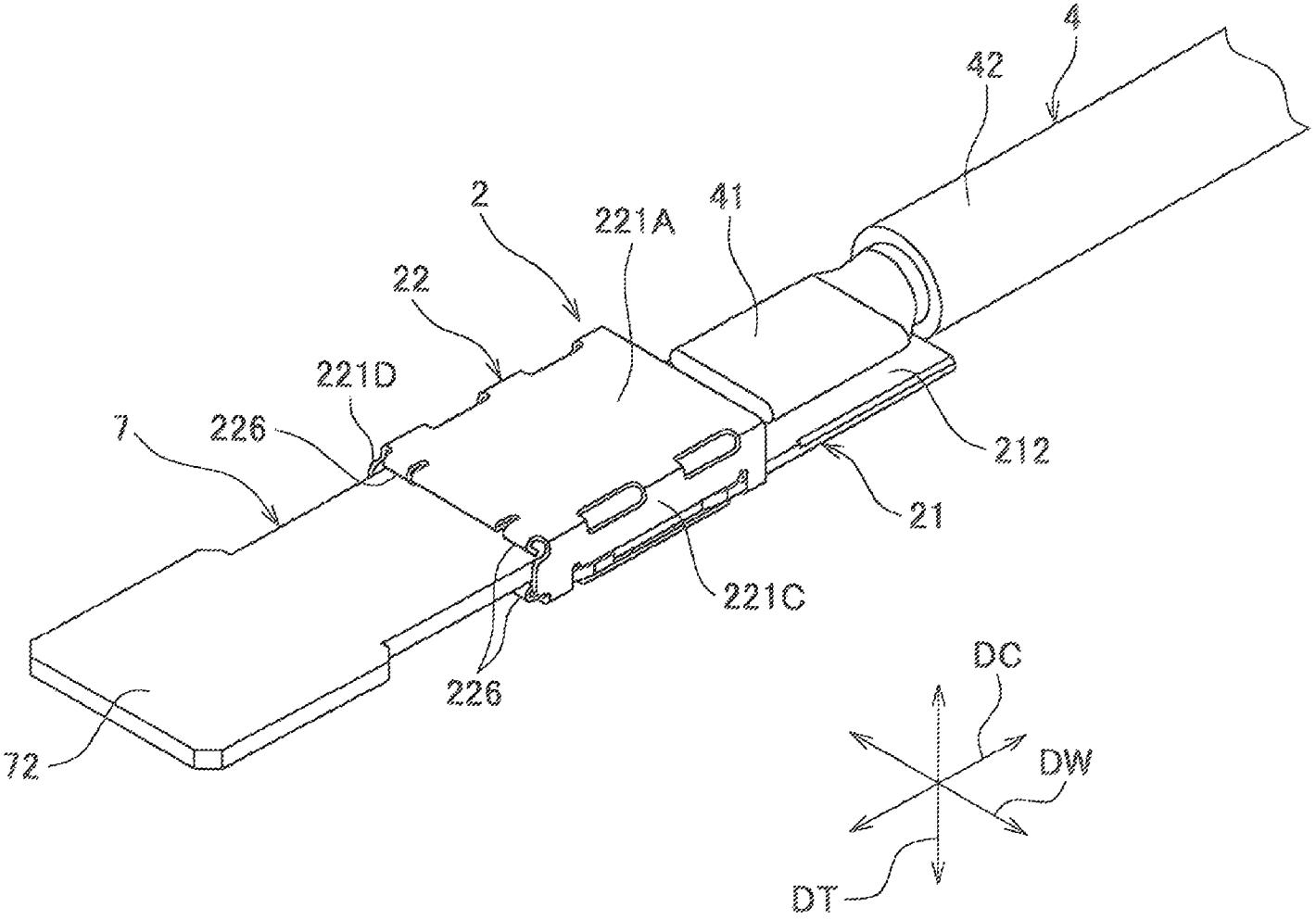
FIG. 16 is a perspective view of the female-side contact shown in FIG. 5 and the male-side contact in a state in which the male-side contact is inserted into the female-side contact.

The supporting member 22 includes a supporting member body 221, the first spring portion 222, the second spring portions 223, and restricting portions 226 (see FIGS. 12 to 14). As a material for the supporting member 22, there may be used, for example, stainless steel. The supporting member 22 is formed by pressing a plate of stainless steel. The supporting member 22 is smaller in thickness than the contact body 21, and hence is excellent in spring property and processability. Note that as a material for the supporting member 22, there may be used copper, copper alloy, or the like in place of stainless steel.

The supporting member body 221 has a square tube shape, and includes an upper wall 221A, a lower wall 221B, the side wall 221C, and the side wall 221D.

The upper wall 221A and the lower wall 221B are opposed to each other in the spring portion-bending direction DT. The side wall 221C and the side wall 221D are at right angles to the upper wall 221A and the lower wall 221B, respectively. A state referred to by the term "right angles" mentioned above includes not only a state of being strictly at right angles but also a state of being substantially at right angles. The side wall 221C and the side wall 221D are opposed to each other in a direction orthogonal to the direction DC of the central axis of the supporting member 22 and the spring portion-bending direction DT (hereinafter referred to as the "width direction DW"). The lower wall 221B is separated into two parts in the width direction DW. A lower wall portion 221B1 as one part of the lower wall 221B is continuous with the side wall 221C, and a lower wall portion 221B2 as the other part of the same is continuous with the side wall 221D.

The hole 221C1, which has a substantially rectangular shape, is formed in a lower part of the side wall 221C, and the hole 221D1, which has a substantially rectangular shape, is formed in a lower part of side wall 221D. The hole 221C1 and the hole 221D1 are the same in shape and size. The protrusions 211C of the contact portion 211 are inserted in the holes 221C1 and 221D1, respectively, whereby the contact portion 211 is supported by the side wall 221C and the side wall 221D in a movable manner.

The first spring portion 222, which is single, extends along the direction DC of the central axis of the supporting member 22 within the supporting member body 221. The first spring portion 222 is bent into a substantially V shape. One end of the first spring portion 222, which is continuous with a front end of the upper wall 221A, is bent into a U shape. Two of the four second spring portions 223 are formed in the lower wall portion 221B1 by cutting and raising, and the other two of the same are formed in the other lower wall portion 221B2 by cutting and raising. The first spring portion 222 and the second spring portions 223 bring the contact portion 71 of the male-side contact 7 inserted into the supporting member body 221 and the contact portion 211 of the contact body 21 into contact with each other.

The restricting portions 226, four in number, restrict the movement of the contact portion 71 of the male-side contact 7 in the spring portion-bending direction DT. Each of two of the four restricting portions 226 extends from the front end of the upper wall 221A, and is bent into a J shape. Each of the other two of the four restricting portions 226 extends from the front end of the lower wall 221B, and is bent into a J shape. The restricting portions 226 on the upper wall 221A side and the restriction portions 226 on the lower wall 221B side are opposed to each other in the spring portion-bending direction DT. The restricting portions 226 on the lower wall 221B side also serve as stopper portions which restrict the movement of the contact portion 211 in a direction of insertion thereof into the supporting member body 221 so as to prevent the same from protruding from the front and of the supporting member body 221. The direction of insertion of the contact portion 211 is parallel to the direction DC of the central axis of the supporting member 22. Further, each restricting portion 226 also functions as a guide for guiding the contact portion 71 of the male-side contact 7 into the supporting member body 221. The position of the front ends of the restricting portions 226 is slightly shifted backward from the position of the front ends of the side wall 221C and the side wall 221D in the direction DC of the central axis of the supporting member 22. Therefore, when the supporting member 22 is accommodated in the female-side housing 3, the restricting portions 226 are avoided from contacting the female-side housing 3, and the restricting portions 226 are prevented from being deformed.

As shown in FIGS. 1 to 4, the female-side housing 3 includes a housing body 31 having a square tube shape, a locking portion 32 having a lever shape, and a pair of side wall portions 33. As a material for the female-side housing 3, there may be used, for example, insulating resin.

The housing body 31 includes a contact accommodating chamber 311 for accommodating the female-side contact 2, and a cable accommodating chamber 312 for accommodating one end of the cable 4.

The locking portion 32 has a wedge-shaped protrusion 321, which can be bent along the spring portion-bending direction DT. The side wall portions 33 in a pair each protrude from an upper surface of the housing body 31 and cover the side surfaces of the locking portion 32.

Next, a description will be given of how to assemble the female connector 1.

First, the core wire 41 of the cable 4 is soldered to the connection portion 212 of the contact body 21.

Next, the contact portion 211 of the contact body 21 is inserted into the supporting member body 221. At this time, the protrusions 211C of the contact portion 211 push the side wall 221C and the side wall 221D of the supporting member 22 outward from the inside to thereby increase the spacing between the side wall 221C and the side wall 221D, and accordingly, the contact portion 211 is slid into the supporting member body 221. When the two protrusions 211C provided on the one side surface of the contact portion body 211A enter the hole 221C1 of the side wall 221C, and the two protrusions 211C provided on the other side surface of the contact portion body 211A enter the hole 221D1 of the side wall 221D, the spacing between the side wall 221C and the side wall 221D return to the original state. A rear end surface 211C1 (see FIG. 13) of each protrusion 211C is at right angles to the direction DC of the central axis of the supporting member 22, and hence the contact portion 211 is prevented by the rear end portions of the side wall 221C and the side wall 221D from moving rearward of the supporting member 22.

Finally, the female-side contact 2 and one end of the cable 4 are accommodated in the contact accommodating chamber 311 and the cable accommodating chamber 312 of the female-side housing 3, respectively.

Thus, through the above-described process, assembly of the female connector 1 is completed.

Next, a description will be given of the male connector 6 which is a mating connector of the female connector 1.

As shown in FIGS. 1 to 4, the male connector 6 is comprised of the male-side contact 7 and a housing 8. The male-side contact 7 includes the contact portion 71 and a connection portion 72. The contact portion 71 having a flat plate shape protrudes into a first accommodating portion 81 of the housing 8, and is brought into contact with the contact portion 211 of the female connector 1 in the first accommodating portion 81. The contact portion 71 is supported by a partition portion 83 which is interposed between the first accommodating portion 81 and a second accommodating portion 82. The core wire 51 of the cable 5 is soldered to the connection portion 72. The cable 5 includes the core wire 51 and a sheathing portion 52 for sheathing the core wire 51. The connection portion 72 is accommodated in the second accommodating portion 82 of the housing 8 together with one end of the cable 5.

The housing 8 has a square tube shape, and includes the first accommodating portion 81 for accommodating the female connector 1. The first accommodating portion 81 accommodates most part of the housing 3 of the female connector 1. The protrusion 321 of the locking portion 32 of the female connector 1 is hooked on a protrusion 811 which is formed at a distal end of the housing 8, whereby the housing 3 of the female connector 1 is mechanically connected to the housing 8 of the male connector 6.

Figure 3:
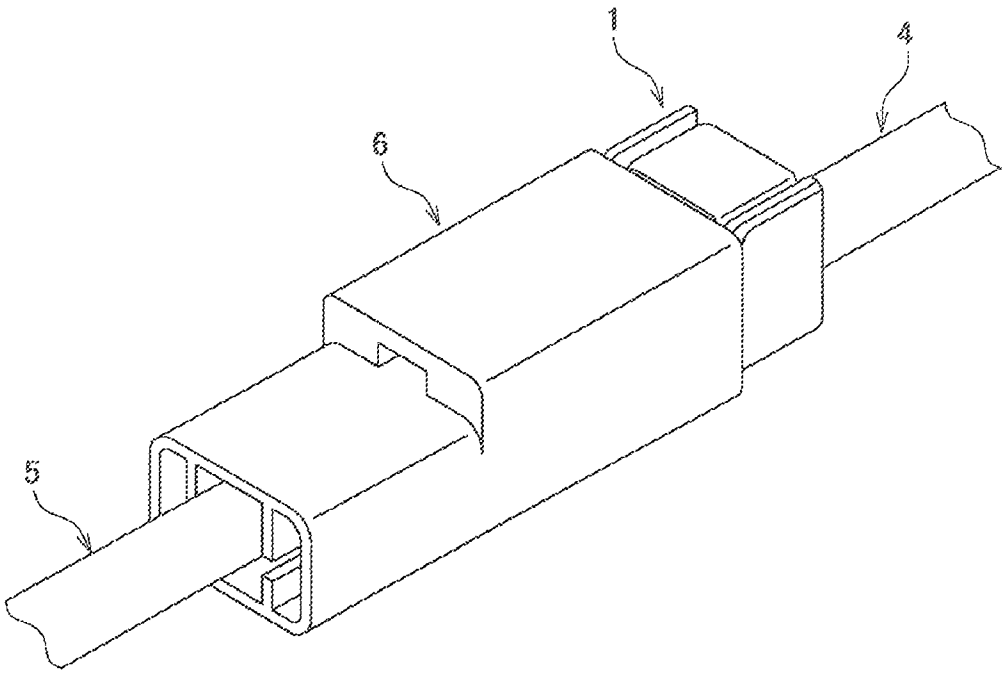
FIG. 3 is a perspective view of the female connector and the male connector in a state in which the male connector is fitted to the female connector appearing in FIG. 1.
Figure 4:
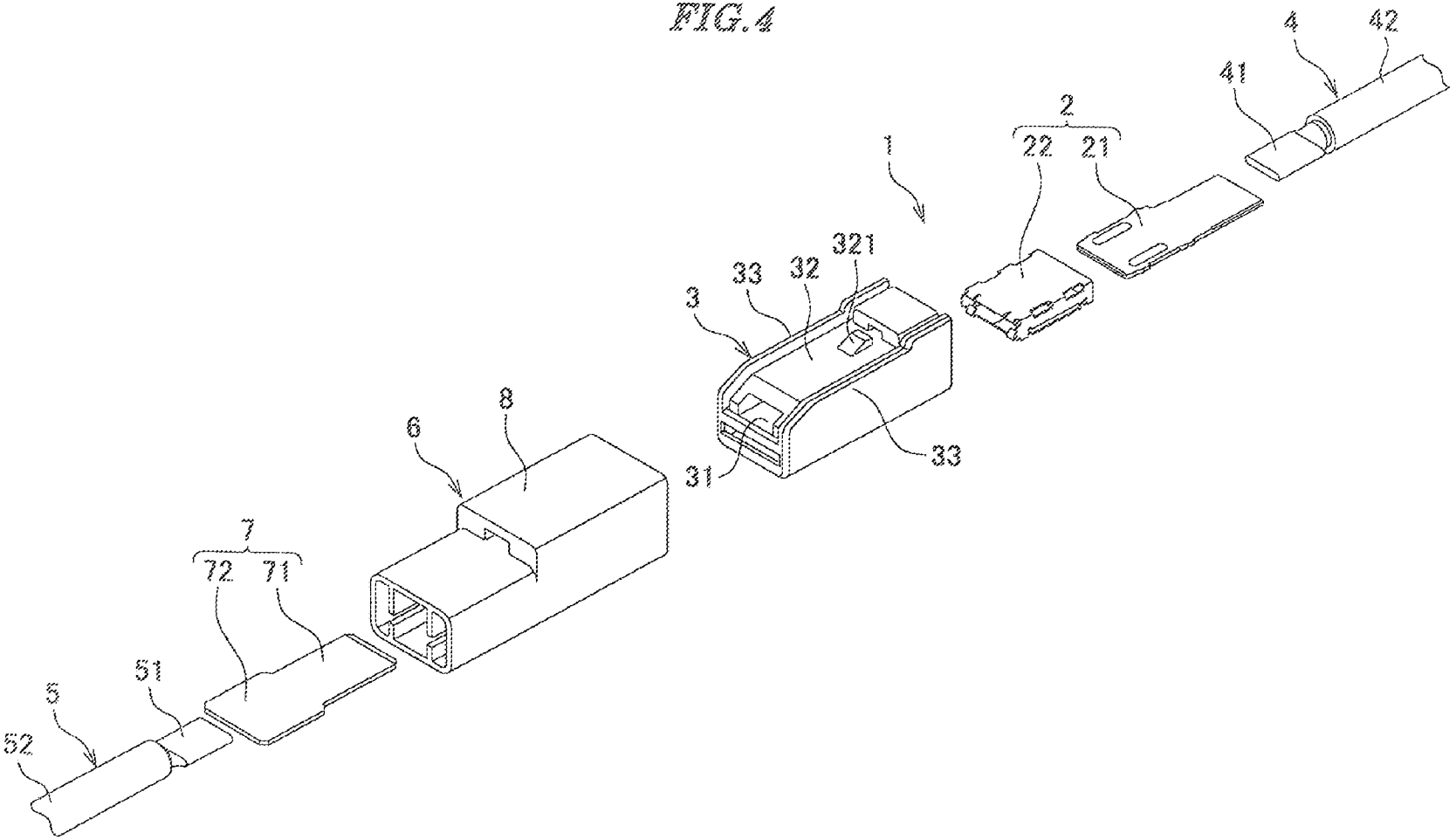
FIG. 4 is an exploded perspective view of the female connector and the male connector shown in FIG. 1.
Figure 5:
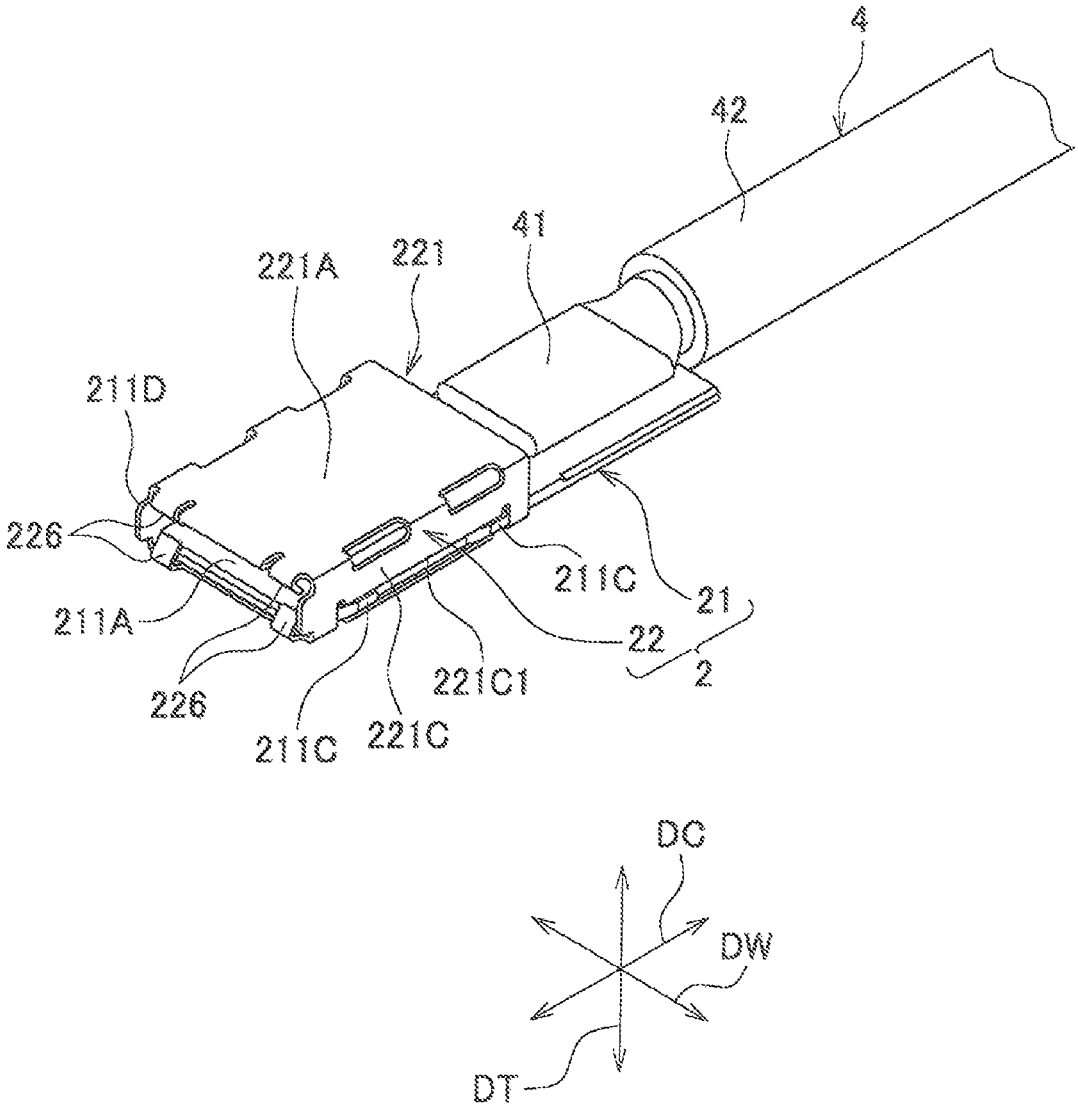
FIG. 5 is a perspective view of a female-side contact of the female connector appearing in FIG. 1.
Figure 6:
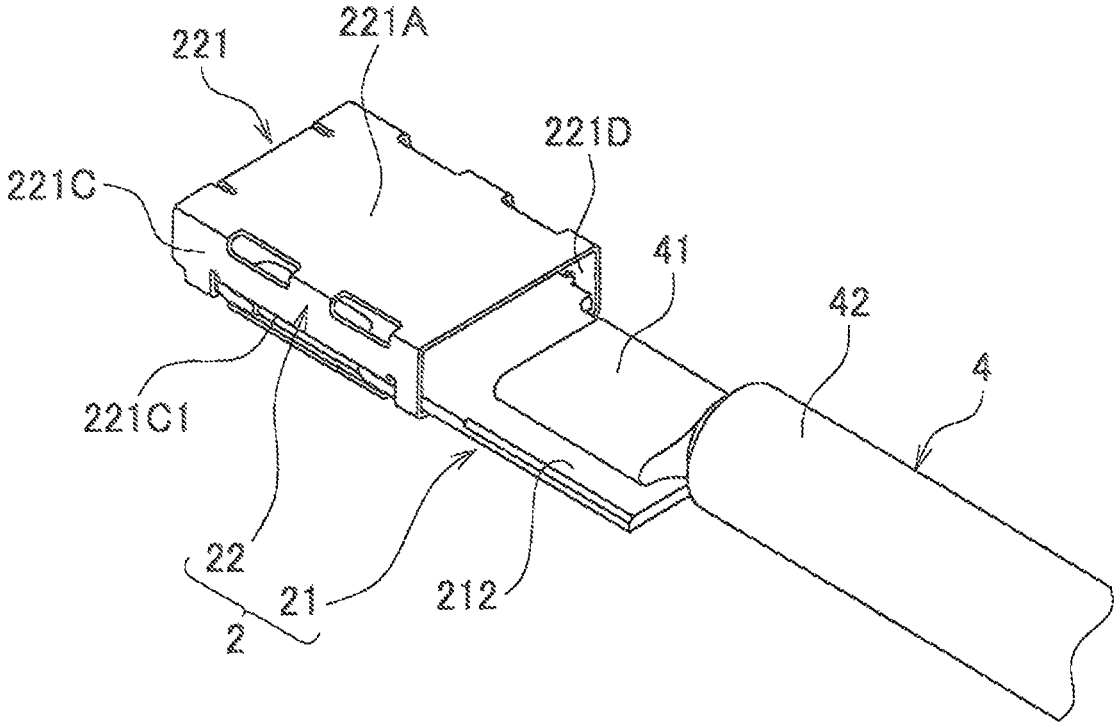
FIG. 6 is a perspective view of the female-side contact shown in FIG. 5, as viewed from a different angle.
Figure 7:
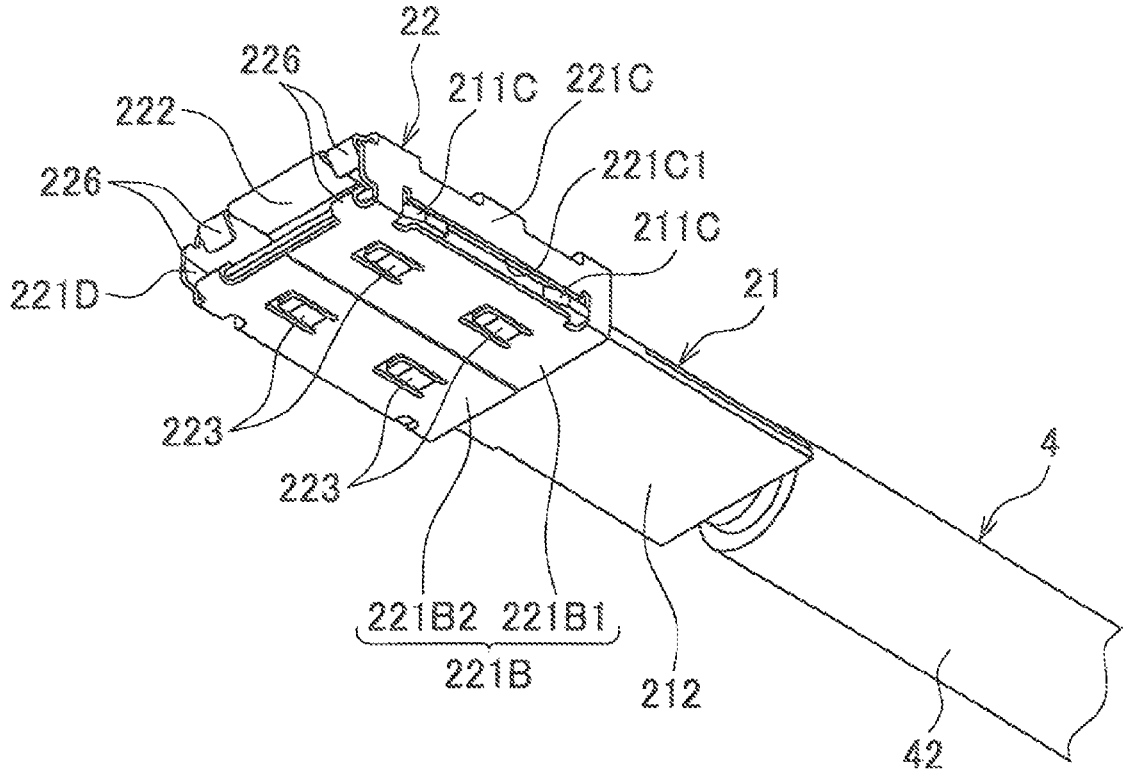
FIG. 7 is a perspective view of the female-side contact shown in FIG. 5, as viewed obliquely from below.
Figure 8:
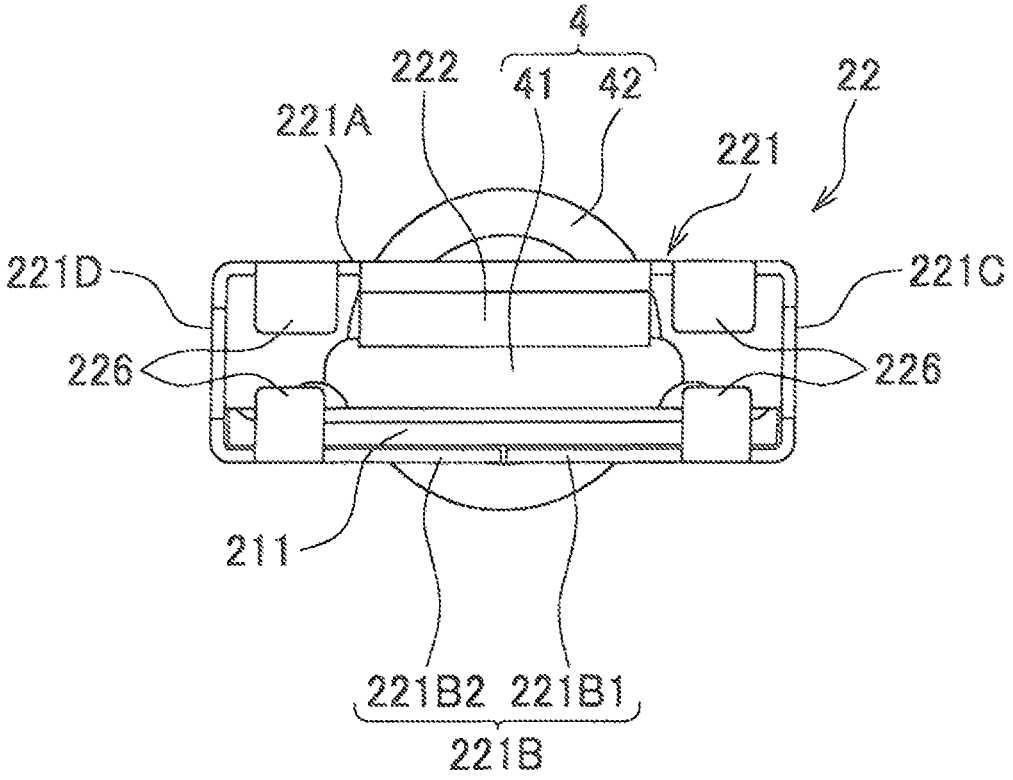
FIG. 8 is a front view of the female-side contact shown in FIG. 5.
Figure 9:
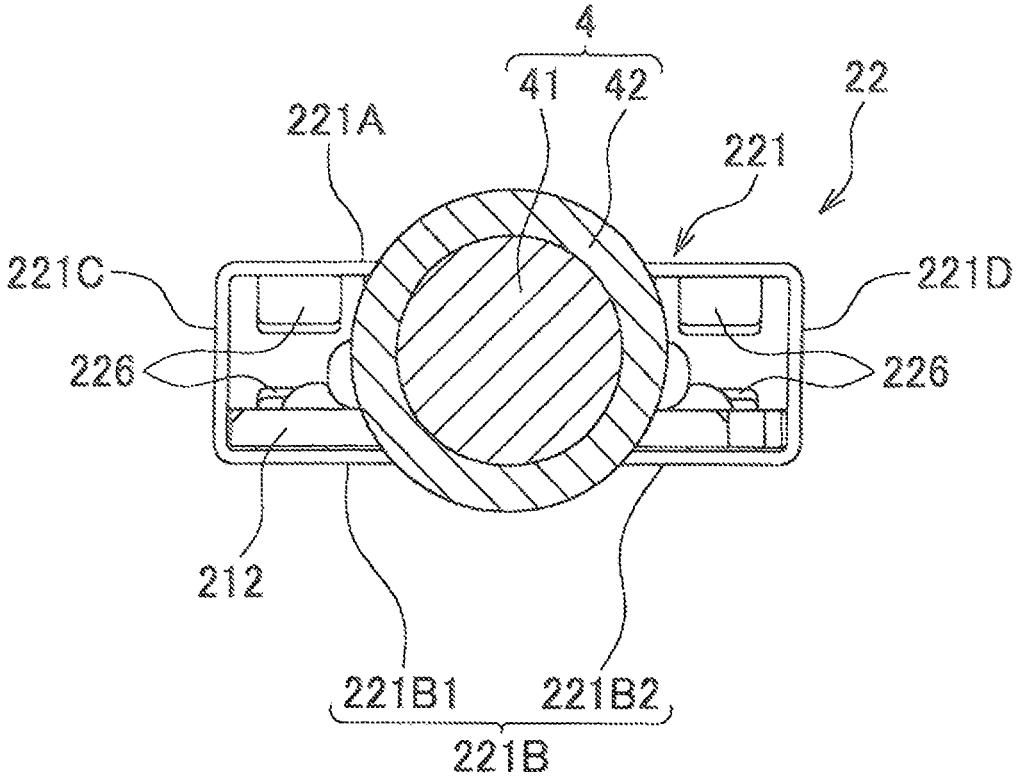
FIG. 9 is a rear view of the female-side contact shown in FIG. 5.
Figure 10:
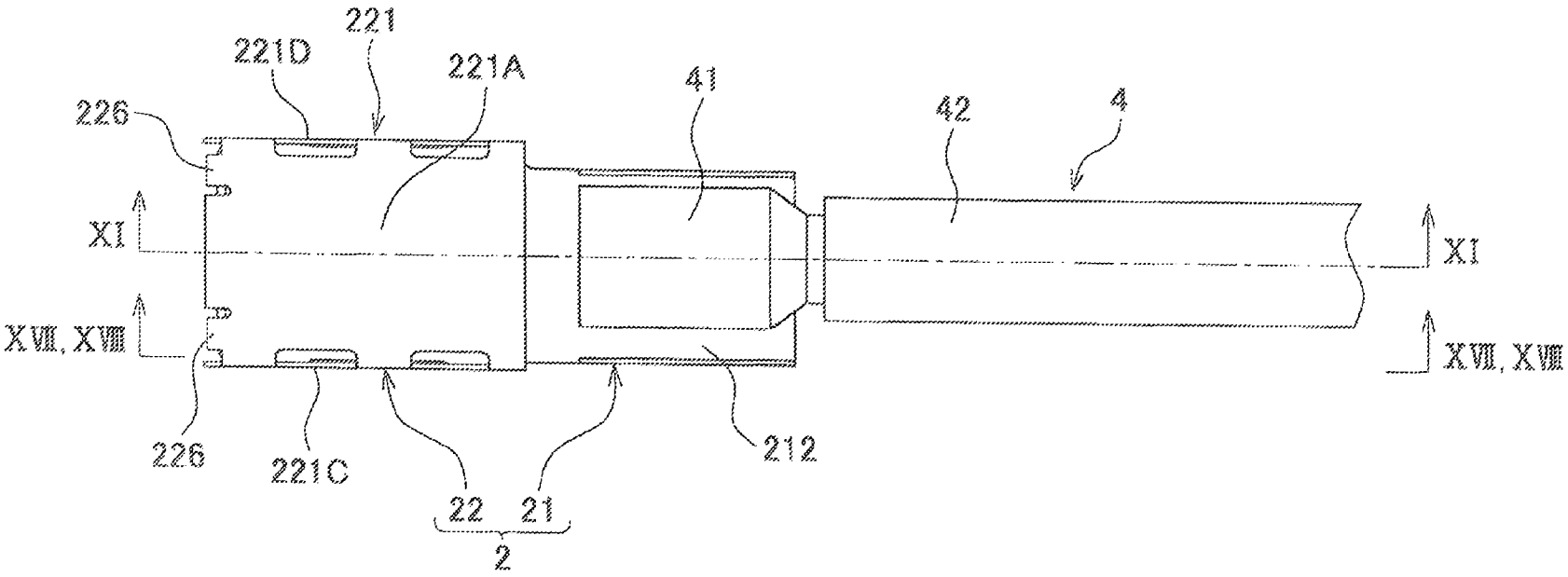
FIG. 10 is a plan view of the female-side contact shown in FIG. 5.

To connect the female connector 1 to the male connector 6, it is only required that first, as shown in FIG. 1, the female connector 1 and the male connector 6 are positioned such that they are opposed to each other, and then, as shown in FIG. 3, the male connector 6 is fitted to the female connector 1.

Figure 17:
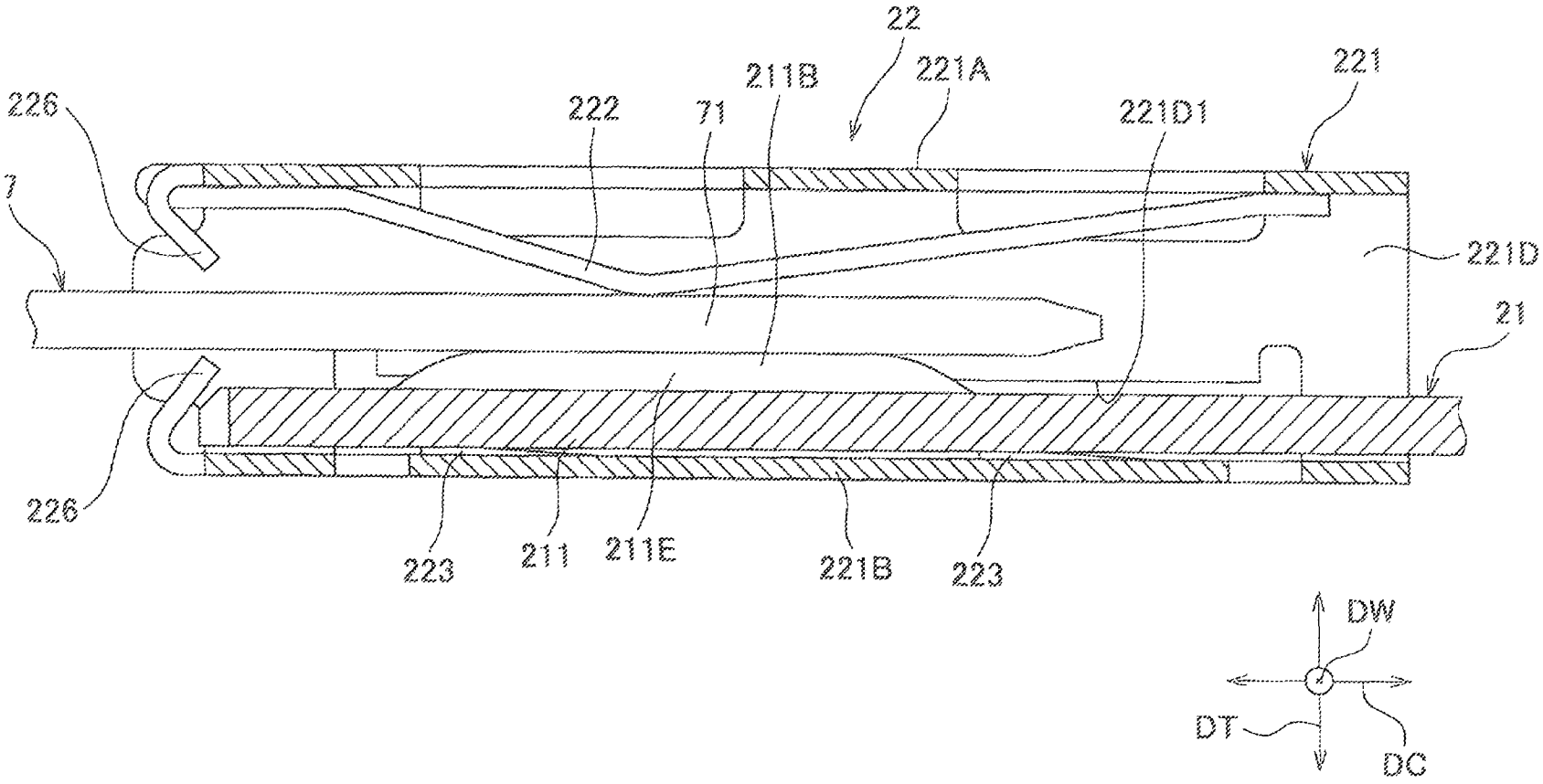
FIG. 17 is an enlarged cross-sectional view of the female-side contact and the male-side contact shown in FIG. 16, taken along XVII-XVII in FIG. 10.

When the male connector 6 is fitted to the female connector 1, as shown in FIG. 17, the contact portion 71 of the male-side contact 7 and the contact portion 211 of the female-side contact 2 are brought into contact with each other by action of the returning forces of the first spring portion 222 and the second spring portions 223 of the supporting member 22. At this time, a lower surface of the contact portion 71 of the male-side contact 7 and the cylindrical surfaces 211E of the contact point portions 211B of the female connector 1 are brought into contact with each other, whereby the female connector 1 and the male connector 6 are electrically connected.

The contact portion 71 of the male-side contact 7 and the contact portion 211 of the female-side contact 2 are sandwiched by the first spring portion 222 and the second spring portion 223, and hence, when the male-side contact 7 is inclined relative to the female-side contact 2 by an external force, the female-side contact 2 is inclined following the male-side contact 7, and the inclination of the male-side contact 7 with respect to the female-side contact 2 is suppressed. On the other hand, when a large external force (external force exceeding forces created by the first spring portion 222 and the second spring portion 223 for suppressing the inclination of the male-side contact 7) acts on the male-side contact 7, the male-side contact 7 is about to be largely inclined but the male-side contact 7 is brought into abutment with the restricting portion 226, whereby the inclination of the male-side contact 7 is restricted. Consequently, reduction in the contact area between the contact portion 71 of the male-side contact 7 and the contact portion 211 of the female-side contact 2 is suppressed.

Figure 18:
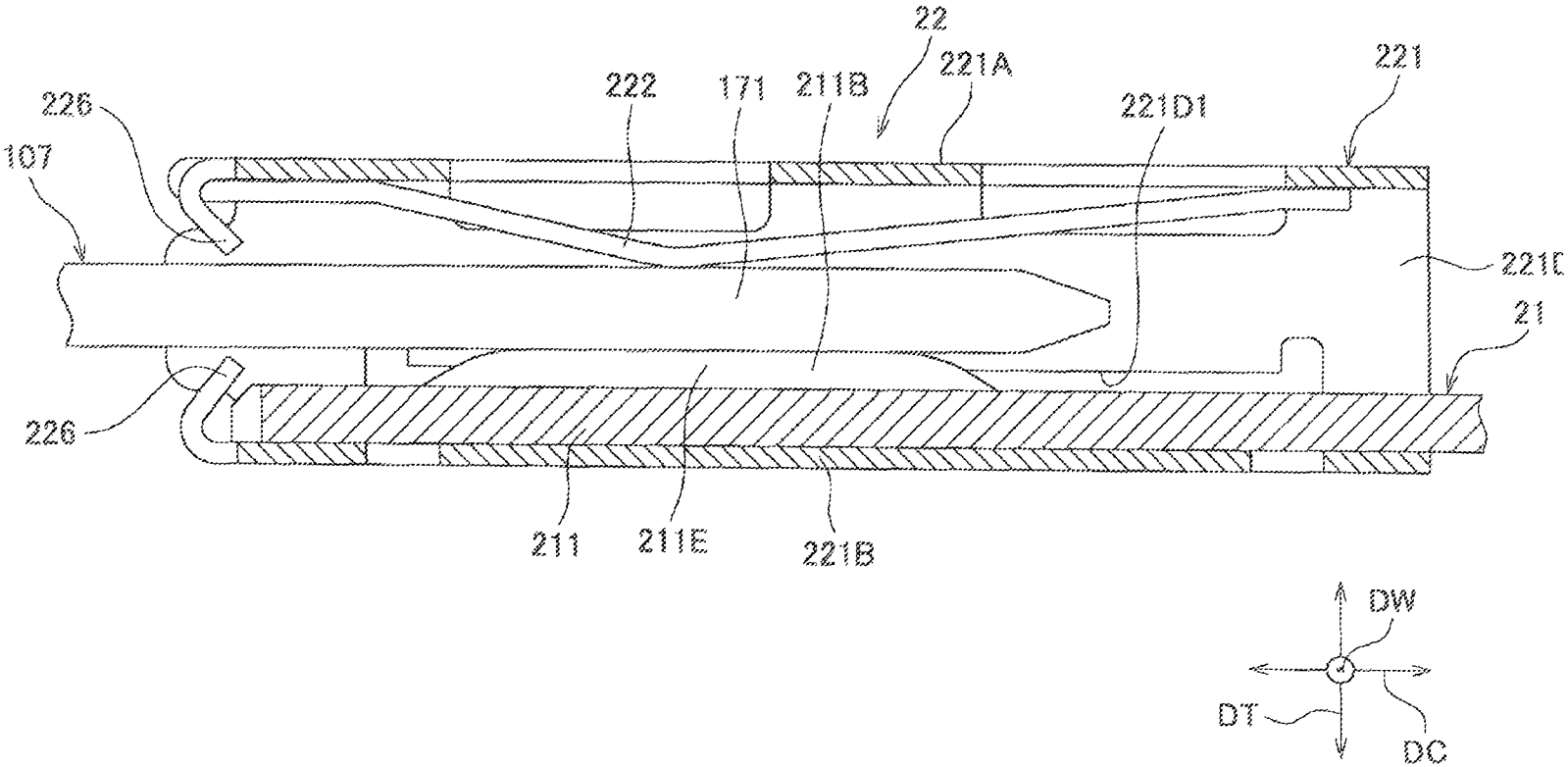
FIG. 18 is an enlarged cross-sectional view, taken along XVIII-XVIII in FIG. 10, of a male-side contact that is larger in thickness than a standard male-side contact, and the female-side contact shown in FIG. 5, in a state in which the male-side contact is inserted into the female-side contact.

As shown in FIG. 18, in a case where a contact portion 171 of a male-side contact 107 which is formed thicker than the male-side contact 7 (see FIG. 17) due to manufacturing variation is inserted into the supporting member body 221, the first spring portion 222 is elastically deformed, and the second spring portions 223 are pushed and elastically deformed by the male-side contact 107 via the contact portion 211 of the female-side contact 2 (in FIG. 18, the second spring portions 223 are hidden in the lower wall 221B and hence invisible). Consequently, the amount of deformation of the first spring portion 222 is suppressed, whereby the first spring portion 222 is prevented from being plastically deformed. Further, when the male-side contact 107 is inclined, the inclination of the male-side contact 107 is restricted by the restricting portions 226, similarly to the case of the male-side contact 7.

According to this embodiment, the restricting portions 226 restrict the inclination of the male-side contact 7 with respect to the female-side contact 2, and hence it is possible to suppress the reduction of the contact area between the contact portion 71 of the male-side contact 7 and the contact portion 211 of the female-side contact 2, caused by the inclination of the male-side contact 7, and suppress a temperature rise caused by an increase in contact resistance, whereby it is possible to increase the contact reliability between the female-side contact 2 and the male-side contact 7.

Figure 19:
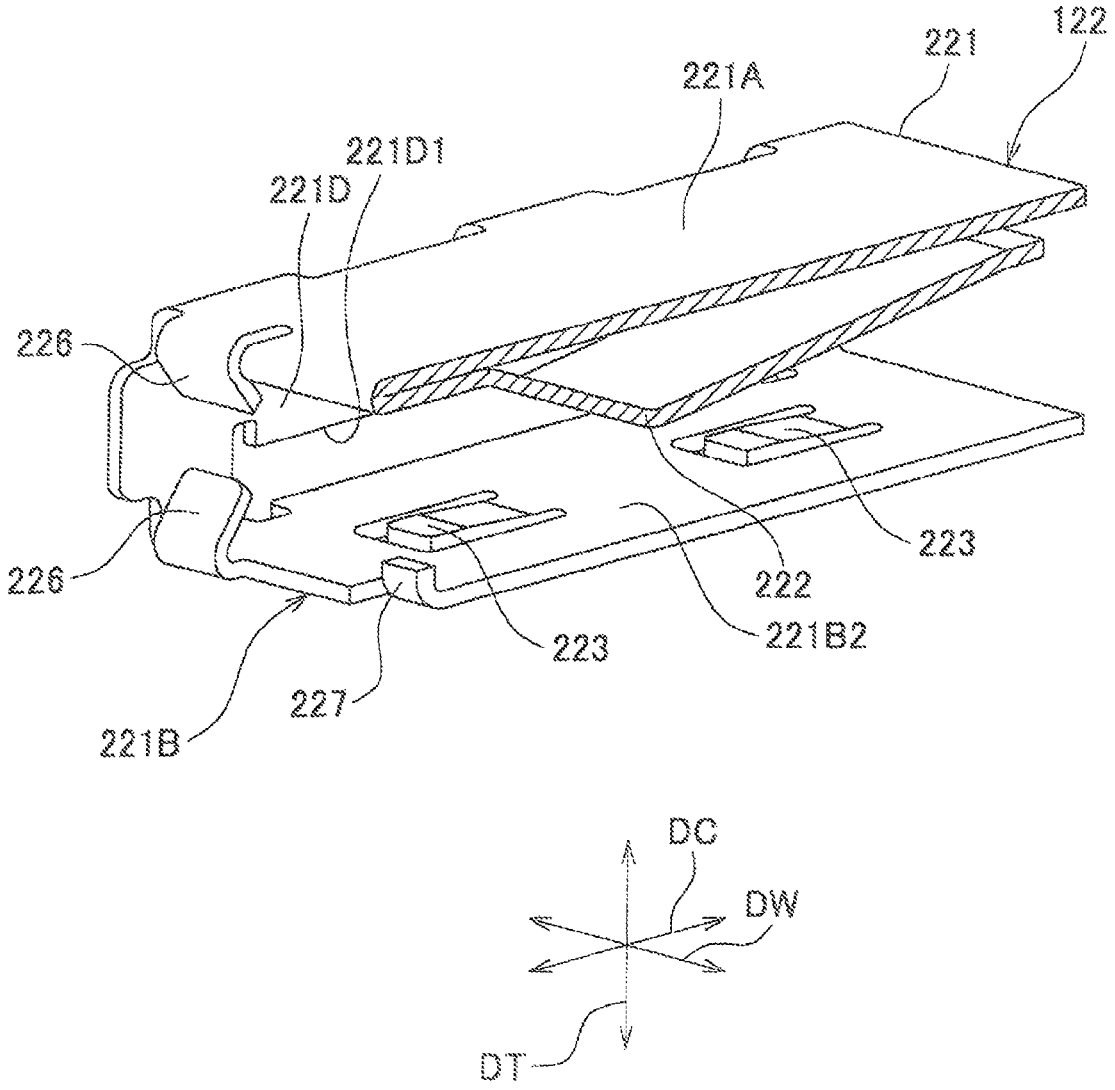
FIG. 19 is a cross-sectional view of a variation of the female-side contact according to a variation of the first embodiment, in a state in which a supporting member thereof is partially cut away.

Next, a description will be given of a variation of the above-described first embodiment with reference to FIG. 19. The same components as those of the first embodiment are denoted by the same reference numerals, and detailed description thereof is omitted. Only main different components from those of the first embodiment will be described hereafter. Note that the contact body according to this variation is common with the contact body 21 according to the first embodiment.

According to the above-described first embodiment, the movement of the contact portion 211 toward ahead of the supporting member 22 (the movement of the contact portion 211 in the direction of insertion thereof into the supporting member body 221) is prevented by the restricting portions 226 on the lower wall 221B. That is, the restricting portions 226 on the lower wall 221B side also serve as stopper portions. On the other hand, according to the variation of the embodiment, aside from the restricting portions 226, L-shaped stoppers 227 for preventing the movement of the contact portion 211 toward ahead of a supporting member 122 are formed on the front ends of the lower wall portions 221B1 and 221B2 of the lower wall 221B.

According to this variation, it is possible to obtain the same advantageous effects as provided by the first embodiment, and it is possible to prevent the contact portion 211 of the contact body 21 from being brought into abutment with the restricting portions 226.

Figure 20:
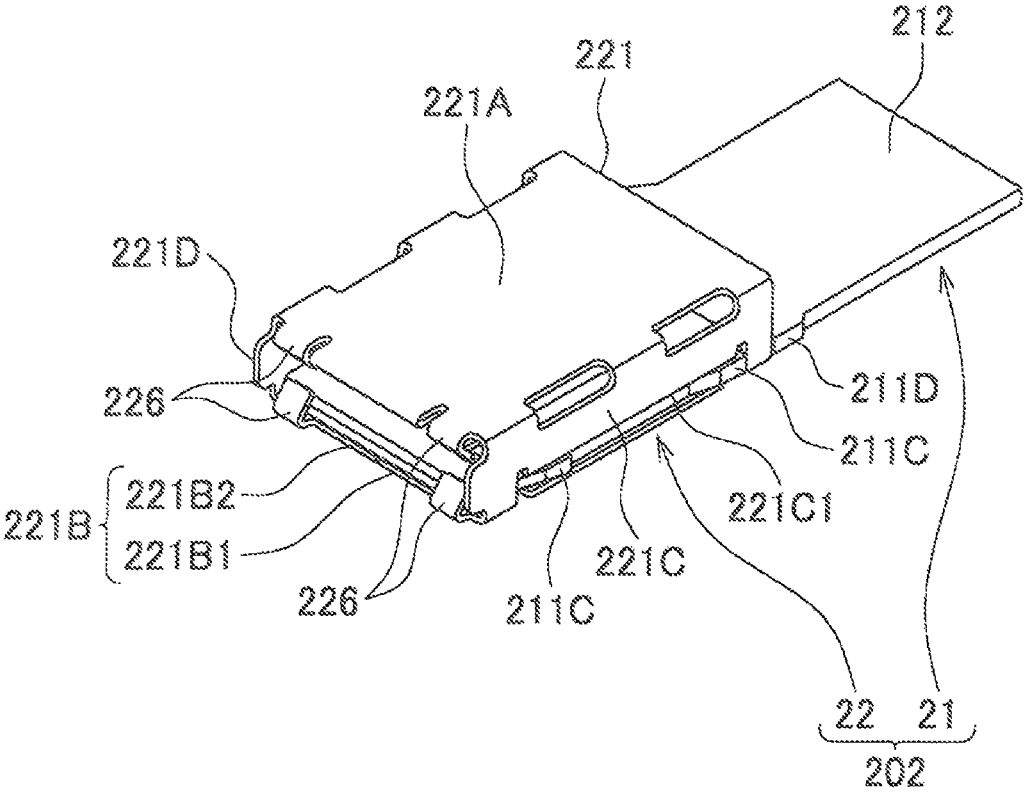
FIG. 20 is a perspective view of a female-side contact of a female connector according to a second embodiment of the present invention.
Figure 21:
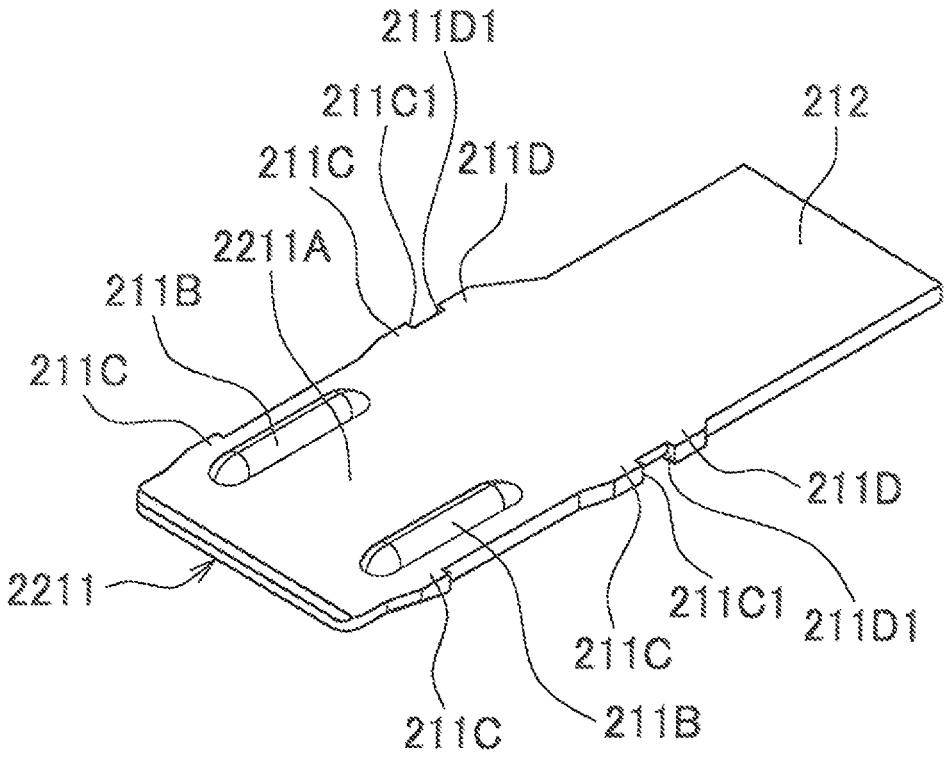
FIG. 21 is a perspective view of a contact body of the female-side contact shown in FIG. 20.
Figure 22:
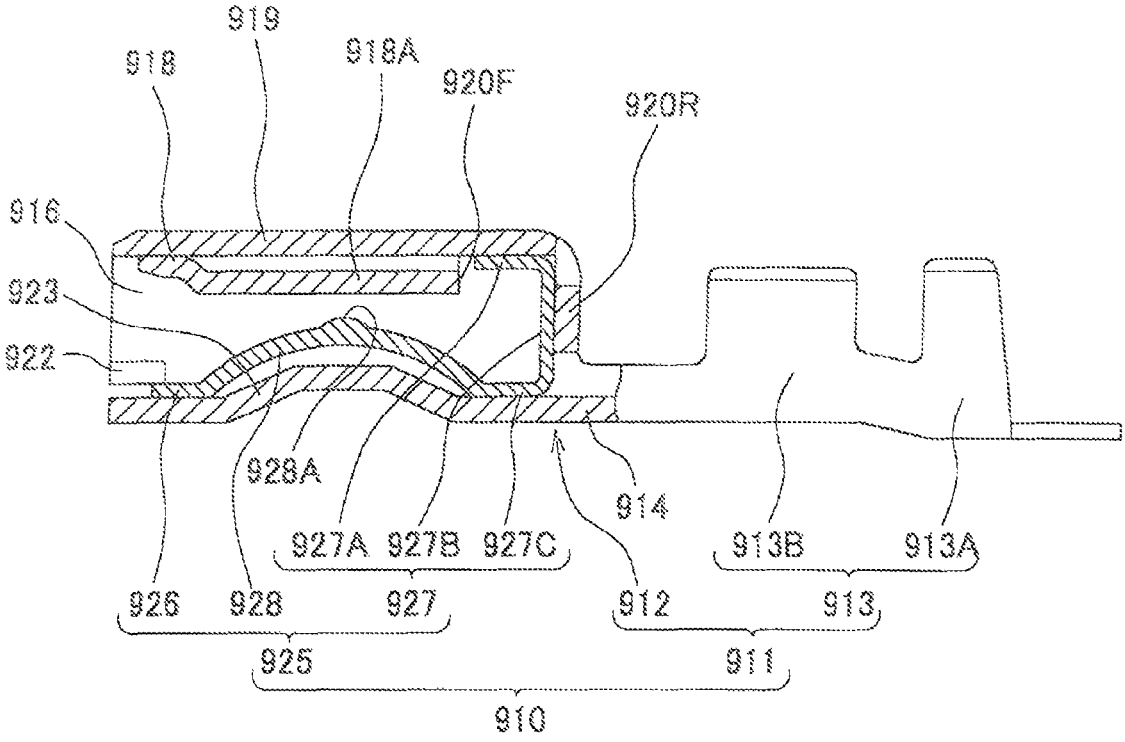
FIG. 22 PRIOR ART
FIG. 22 is a partially cutaway cross-sectional view of a conventional contact.
Figure 23:
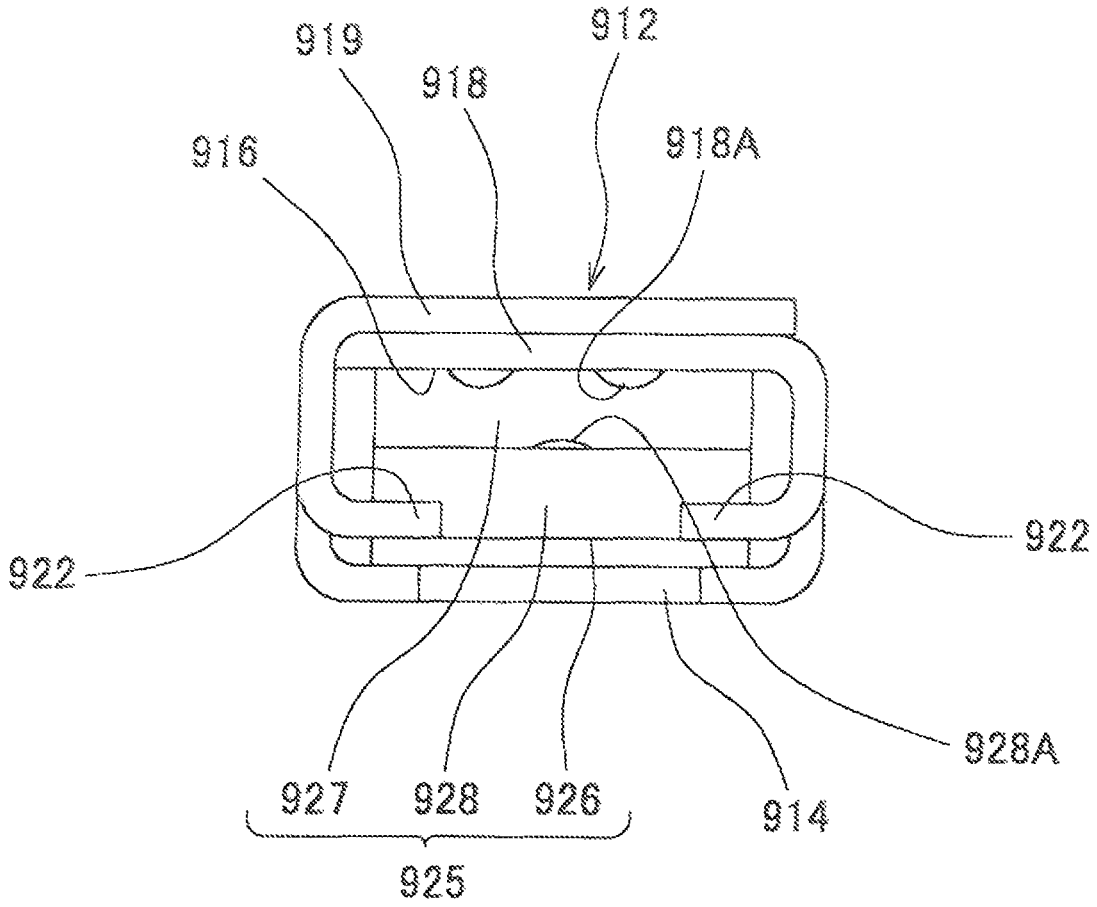
FIG. 23 PRIOR ART
FIG. 23 is a front view of the contact shown in FIG. 22.
Figure 24:
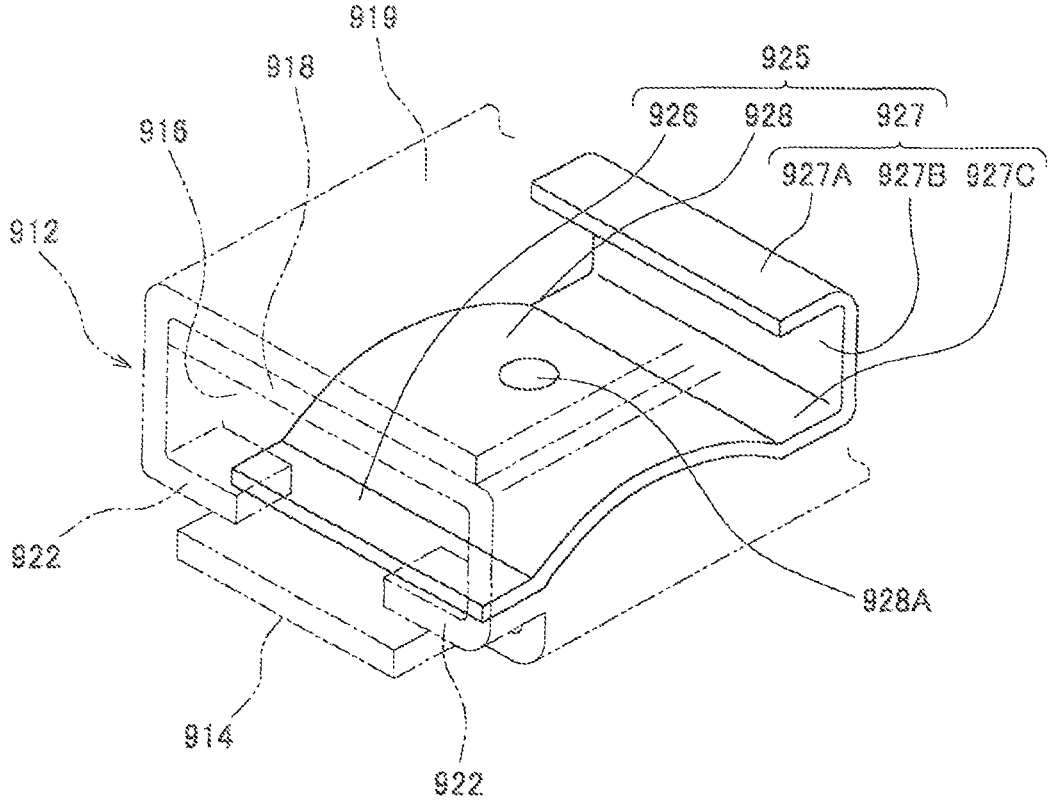
FIG. 24 PRIOR ART
FIG. 24 is a perspective view of an elastic contact body appearing in FIG. 22.

Next, a description will be given of a second embodiment of the present invention with reference to FIGS. 20 and 21. The same components as those of the first embodiment are denoted by the same reference numerals, and detailed description thereof is omitted. Only main different components from those of the first embodiment will be described hereafter.

According to the first embodiment, the protrusions 211C are provided in pairs on the opposite side surfaces of a contact portion body 211A, respectively. On the other hand, according to the second embodiment, three protrusions 211C, 211D, and 211D are formed on each of the opposite side surfaces of a contact portion body 2211A. The rear ends of the side walls 221C and 221D of the supporting member 22 are sandwiched between the protrusion 211C on the rear side and the protrusion 211D of the three protrusions 211C, 211C, and 211D, whereby it is possible to prevent the movement of the contact portion 211 toward ahead of the supporting member 22. The rear end surface 211C1 of the protrusion 211C on the rear side, and a front end surface 211D1 of the protrusion 211D are at right angles to the direction DC of the central axis of the supporting member 22. A state referred to by the term "right angles" mentioned above includes a state of being substantially at right angles.

According to the second embodiment, it is possible to obtain the same advantageous effects as provided by the first embodiment, and it is possible to prevent the contact portion 2211 of the contact body 21 of a female-side contact 202 from being brought into abutment with the restricting portions 226.

Although in the above-described embodiments and the like, the supporting members 22 and 122 each include both the first spring portion 222 and the second spring portions 223, the supporting member 22 may be provided with either the first spring portion 222 or the second spring portions 223.

Further, although in the above-described embodiments and the like, one first spring portion 222 and four second spring portions 223 are provided, each of the first spring portion 222 and the second spring portion 223 may be either single or plural.

Further, although in the above-described embodiments and the like, the supporting members 22 and 122 each have a square tube shape and include the upper wall 221A and the lower wall 221B, the shape of the supporting member is not limited to the square tube shape. For example, the supporting member may be formed into a U shape in cross-section. In this case, the supporting member includes one of the upper wall (wall) 221A and the lower wall (wall) 221B.

In a case where each of the supporting members 22 and 122 accommodated in the contact accommodating chamber 311 of the housing 3 has a U shape in cross-section, portions where the protrusions 211C and 211D are inserted may be either the holes 221C1 and 221D1 or cutouts (not shown).

Further, although in the above-described embodiments and the like, the object to which each of the female-side contacts 2 and 202 of the female connector 1 is to be connected is the cable 4, the object to which each of the female-side contacts 2 and 202 is to be connected is not limited to the cable 4.

Although in the above-described embodiments and the like, the contact body 21 is larger in thickness than each of the supporting members 22 and 122, the contact body 21 may be equal in thickness to each of the supporting members 22 and 122.

Further, although in the above-described embodiments and the like, each contact point portion 211B has a semicircular shape in cross-section, the contact point portion may have a substantially trapezoidal shape (not shown) in cross-section.

Further, although in the above-described embodiments and the like, each restricting portion 226 has a J shape in cross-section, the shape of the restricting portion is not limited to the J shape insofar as the restricting portion has a shape that restricts the movement of each of the male-side contacts 7 or 107 in the spring portion-bending direction DT. For example, the restricting portion may have a C shape (not shown) in cross-section.

Further, although in the above-described embodiments and the like, the connection portion 212 has a flat plate shape, and the core wire 41 of the cable 4 is soldered to the connection portion 212, the connection portion is not limited to this. For example, the connection portion may include a crimp portion (not shown) that is crimped to hold the core wire 41 of the cable 4 and a crimp portion (not shown) that is crimped to hold the sheathing portion 42 of the cable 4.

It is further understood by those skilled in the art that the foregoing are the preferred embodiments of the present invention, and that various changes and modification may be made thereto without departing from the spirit and scope thereof.

What is claimed is:

1. A contact comprising:

a contact body including a contact portion that is configured to be brought into contact with a mating contact portion of a mating contact, and a supporting member that is a component separate from the contact body, is configured to receive therein the mating contact portion, and supports the contact portion in a movable manner, wherein the supporting member includes:

a supporting member body that is configured to receive therein the mating contact portion and the contact portion, a spring portion that is provided on the supporting member body, for bringing the mating contact portion inserted into the supporting member body and the contact portion into contact with each other, and a restricting portion that is provided on the supporting member body, for restricting movement of the mating contact in a direction of bending of the spring portion, wherein the contact portion includes a contact portion body having a flat plate shape, and a contact point portion protruding from the contact portion body into an inside of the supporting member body, wherein the supporting member body has a square tube shape, wherein the supporting member body includes an upper wall and a lower wall which are opposed to each other, and wherein the spring portion is provided on the upper wall and the lower wall.

2. The contact according to claim 1, wherein the contact point portion extends in a direction of a central axis of the supporting member.

3. The contact according to claim 1, wherein the supporting member body includes a pair of side walls which are at right angles to the upper wall and the lower wall, respectively, and are opposed to each other, wherein the pair of side walls each have a hole formed therethrough, and wherein the contact portion includes a plurality of protrusions which are continuous with the contact portion body, and are inserted into the holes and supported by the pair of side walls in a movable manner.

4. The contact according to claim 2, wherein the supporting member body includes a pair of side walls which are at right angles to the upper wall and the lower wall, respectively, and are opposed to each other, wherein the pair of side walls each have a hole formed therethrough, and wherein the contact portion includes a plurality of protrusions which are continuous with the contact portion body, and are inserted into the holes and supported by the pair of side walls in a movable manner.

5. The contact according to claim 1, wherein the restricting portion is provided on each of the upper wall and the lower wall.

6. The contact according to claim 3, wherein the restricting portion is provided on each of the upper wall and the lower wall.

7. The contact according to claim 1, wherein the supporting member includes a stopper portion for restricting movement of the contact portion in a direction of insertion thereof into the supporting member body.

8. The contact according to claim 2, wherein the supporting member includes a stopper portion for restricting movement of the contact portion in a direction of insertion thereof into the supporting member body.

9. The contact according to claim 7, wherein the restricting portion also serves as the stopper portion.

10. The contact according to claim 8, wherein the restricting portion also serves as the stopper portion.

11. The contact according to claim 1, wherein the restricting portion has a J shape in cross-section.

12. The contact according to claim 1, wherein the contact body is different in thickness from the supporting member, and the contact body is larger in thickness than the supporting member.

13. The contact according to claim 1, wherein the contact body includes a connection portion that is continuous with the contact portion and is connected to an object to be connected.

14. The contact according to claim 13, wherein the object to be connected is a cable.

15. A connector comprising:

a contact including:

a contact body including a contact portion that is configured to be brought into contact with a mating contact portion of a mating contact, and a supporting member that is a component separate from the contact body, is configured to receive therein the mating contact portion, and supports the contact portion in a movable manner, wherein the supporting member includes:

a supporting member body that is configured to receive therein the mating contact portion and the contact portion, a spring portion that is provided on the supporting member body, for bringing the mating contact portion inserted into the supporting member body and the contact portion into contact with each other, and a restricting portion that is provided on the supporting member body, for restricting movement of the mating contact in a direction of bending of the spring portion, wherein the contact portion includes a contact portion body having a flat plate shape, and a contact point portion protruding from the contact portion body into an inside of the supporting member body, wherein the supporting member body has a square tube shape, wherein the supporting member body includes an upper wall and a lower wall which are opposed to each other, and wherein the spring portion is provided on the upper wall and the lower wall; and a housing that accommodates the contact, and holds the supporting member.

* * * * *